US005408915A

United States Patent [19]

Stoner

[11] Patent Number: 5,408,915

[45] Date of Patent: Apr. 25, 1995

[54] SHELL FEEDER FOR AN AUTOMATIC GUN

[76] Inventor: Eugene M. Stoner, 6055 SW. Mapp Rd., Palm City, Fla. 33490

[21] Appl. No.: 167,479

[22] Filed: Dec. 14, 1987

Related U.S. Application Data

[62] Division of Ser. No. 524,387, Aug. 18, 1983.

[51] Int. Cl.[6] ..... F41A 9/29

[52] U.S. Cl. ..... 89/33.14; 89/12; 89/33.4

[58] Field of Search ..... 89/33.14, 33.4, 33.16, 89/33.01, 12

[56] References Cited

U.S. PATENT DOCUMENTS

| | | | |
|---|---|---|---|
| 3,760,683 | 9/1973 | Seemann | 89/12 |
| 4,252,049 | 2/1981 | Franz et al. | 89/34 |
| 4,253,376 | 3/1981 | Washburn et al. | 89/34 |
| 4,269,109 | 5/1981 | Stoner | 89/198 |
| 4,494,440 | 1/1985 | Koine | 89/33.16 |
| 4,573,395 | 3/1986 | Stoner | 89/33.16 |
| 4,676,138 | 6/1987 | Thompson et al. | 89/33.14 |
| 4,765,223 | 8/1988 | Beckmann | 89/33.16 |

*Primary Examiner*—David Brown

[57] ABSTRACT

An automatic cannon, especially for cylindrical, telescoped shells, comprises a receiver in which is rotatably mounted an interconnected gun barrel and barrel extension or rotor. The rotor is connected to a power source, which may be an external source, for being driven at a relatively uniform rotational velocity for firing. A chamber having two laterally spaced apart, feed through, shell-holding cavities, is radially slidably mounted in a centrally located, transverse rotor aperture. Three cooperative camming means, responsive to rotor rotation, cause shell feeding, firing and ejection. Shell camming means simultaneously transport shells from an associated feeder into the chamber cavities and fired shell casings from the chamber cavities to a receiver ejection port. Chamber camming means cause the chamber to slide radially, while rotating, so that each of the shell holding cavities trace out a preferably cardioid-shaped path, the cavities being aligned with barrel for shell firing at the cusp of the path so that a preselected firing dwell time of the cavities at the firing position is provided. Shells are fed into the cavities and fired casings are pushed from the cavities when the cavities are out of alignment with the barrel. Firing pin camming means operate a rotor-mounted firing pin in a manner that shells are fired as soon as they are moved by the chamber into the firing position. Preferably first and second camming means are generally symmetrical so that the gun can be operated in either rotor rotational direction, with shells being fed forwardly for one rotational direction and rearwardly for the opposite rotational direction.

7 Claims, 9 Drawing Sheets

SHELL FEEDER FOR AN AUTOMATIC GUN

This application is a division of application Ser. No. 06/524,387, filed Aug. 18, 1983.

BACKGROUND OF THE INVENTION

1. Field of the Invention:

The present invention relates generally to the field of automatic guns and more particularly to automatic cannon.

2. Discussion of the Prior Art:

Automatically firing guns can be generally classified as either self-powered or externally-powered. Self powered guns, which include most automatic small arms and many types of automatic cannon, typically employ high pressure gases generated by firing for their automatic operation. Upon firing, the high pressure barrel gases of such guns are used to drive a bolt (bolt group) rearwardly from the breech at a high recoil velocity. The recoiling bolt extracts, or helps to extract, the just-fired shell casing from the breech and subsequently causes ejection of the casing from the gun. On counter-recoil, normally after impacting some type of recoil buffer, the bolt strips an unfired shell from an associated feeder or magazine and rams the shell forwardly into the firing chamber. Typically the chambered shell is fired automatically when the bolt reaches, and temporarily locks to, the breech. Firing is stopped by searing up the bolt at a rearward position in readiness for a next firing; springs drive the bolt forwardly to reinitiate firing upon unsearing. Exemplary of such gas-operated, automatic guns is the open framework receiver cannon disclosed in my prior U.S. Pat. No. 4,269,109.

Some other types of self-powered, automatic guns utilize recoil forces caused by the gun's firing for operation. Firing recoil forces drive the bolt rearwardly in recoil; otherwise, gun operation is typically the same as for gas-operated automatic guns. Still other types of automatic guns may use both the high pressure gases and recoil forces from firing for automatic operation.

For such reasons as easy portability and compactness, virtually all automatic (and semi-automatic) small arms are self-powered. Some gas or recoil operated automatic cannon may use external power for shell feeding; nevertheless, such guns are usually still considered to be self-powered. Self-powered guns, however, have some disadvantages. As an illustration, because operation of self-powered guns depends upon firing of the gun, failure of a shell to fire, as may sometimes occur, causes the gun to stop firing. Moreover, if shell feeding is slow for any reason and there is no shell in position for the counterrecoiling bolt to pick up, firing stops. Furthermore, self-powered automatic guns are difficult to properly time because of different characteristics of different types of shells which may be fired in the gun, and because of shell-to-shell variations in any one type of shell being fired. When gun operation is not properly timed, unexpectedly high parts stress may occur and/or firing accuracy may be adversely affected. Good self-powered gun design must ordinarily take into account worst case timing conditions and performance may, therefore, be somewhat compromised.

In contrast, the operations of shell loading, firing, extraction and ejection of externally-powered automatic guns are performed by such externally provided forces as electric, hydraulic or air motors, the operations being, therefore, completely independent of actual shell firing. Any shells which fail to fire are automatically extracted and ejected without otherwise affecting the gun's firing operation. Moreover, proper timing is easier to attain in externally-powered automatic guns than in self-powered guns because of the independence on firing. For such reasons, higher firing rates can typically be attained in externally-powered guns than in comparable self-powered automatic guns.

An example of externally-powered, automatic guns is the modern Gatling gun, which employs several, usually three to six, gun barrels mounted together around a small circle, through the center of which passes a barrel rotational axis. In response to an external motor spinning the barrel assembly at a high rotational velocity, camming mechanisms cause shell loading, firing, extraction and ejection. Such guns have extremely high firing rates since they are constructed so that while one barrel is firing, another or others are being loaded, while shells are being extracted from still other barrels. A disadvantage of this particular type automatic gun is that it uses relatively complicated mechanisms and so is relatively expensive to produce and to maintain.

Depending upon the particular military weapons system involved, a self-powered or an externally-powered automatic gun may be preferred and/or specified. Typically self-powered automatic cannon are preferred for lightweight, mobile, land-based gun systems, so as to avoid the added weight and complexity of external gun-drive apparatus. However, for many other critical weapons systems, such as those used in airborn applications, externally-powered guns may be preferred because of their normally higher firing rates and potentially greater reliability of operation.

However, because of the obvious criticality of weapons systems using automatic cannon, and as a result of the necessity to continually upgrade gun performance standards so as to compensate for improvements in enemy weaponry, design improvements are continually needed to enhance gun performance while at the same time reducing size, weight, cost and complexity and increasing gun maintainability, reliability and service life.

Along with improvements to the guns themselves, continual improvements to ammunition used by these guns are also needed, with much current effort in this regard being directed towards development of cylindrical, telescoped shells wherein the projectile is fully disposed within the casing and surrounded by propellant. Such shells are substantially larger in diameter than conventional shells of corresponding calibre but are much shorter, thereby enabling correspondingly shorter bolt strokes and faster gun operation. Due to their uniform shape, feeding of cylindrical shells is also usually simpler than the feeding of conventional shells, and shell magazine packing densities can, for the most part, be substantially increased when cylindrical shells are used.

It is therefore, one object of the present invention to provide an automatic gun, for firing cylindrical, telescoped ammunition, which has relatively few parts so as to be comparatively less expensive to construct and maintain and comparatively more reliable than heretofore available automatic guns.

Another object of the present invention is to provide an automatic gun, for firing cylindrical, telescoped ammunition, having a barrel which axially rotates with other rotating parts of the gun during firing of the gun.

Still another object of the present invention is to provide an externally-powered, automatic gun, for firing cylindrical, telescoped ammunition, having a barrel and having a chamber which slides radially as it rotates with the barrel in such a manner that the longitudinal axis of a shell held in the chamber is aligned for a preselected dwell time with the bore axis of the barrel at the time of firing.

A further object of the present invention is to provide an automatic gun, for firing cylindrical, telescoped ammunition, having a rotating barrel and a rotating and radially sliding chamber, a shell cavity of which is constrained to travel along a cardioid-shaped path, the cavity being aligned with the barrel at the cusp of the curve for shell firing, and elsewhere along the curve being out of alignment with the barrel so that shell loading and shell extraction operations can be performed.

Other objects, features and advantages of the present invention will be readily apparent from the following detailed description when taken in conjunction with the accompanying drawings.

SUMMARY OF THE INVENTION

According to the present invention, a rapid firing gun for firing cylindrical, telescoped ammunition comprises a receiver having a shell feeding port and a fired shell casing ejection port, the ports being spaced apart from one another in an axial direction, and a shell firing position being defined between the feeding and ejecting ports. Further comprising the gun are a gun barrel and means mounting the barrel to the receiver with the rearward end of the barrel forwardly adjacent to the shell firing position.

Rotor means are rotatably mounted in the receiver for causing, in response to rotor rotation, the transporting of shells in a generally axial direction from the shell feeding port to the firing position, the dwelling of shells in the firing position for a predetermined shell firing dwell time, and the transporting of fired shell casings in the same general axial direction from the firing position to the shell ejection port. Included are drive means connected to the rotor means for causing, during firing of the gun, rotation of the rotor means, thereby causing transporting of shells from the feeding port to the firing position and transporting of fired shell casings from the firing position to the ejection port. Firing means, timed with rotation of the rotor means, are provided for causing the firing of shells positioned in the firing position.

During firing of the gun the drive means preferably cause rotation of the rotor means in a substantially continuous manner and more preferably in a substantially continuous manner. Also preferably, a single barrel is connected to the rotor means so as to rotate in unison therewith.

Included in the rotor means are a chamber having means defining at least one shell holding cavity and means defining a transverse aperture for non-rotatably retaining the chamber while permitting radial sliding movement thereof. Chamber camming means, responsive to rotation of the rotor means, cause radial sliding movement of the chamber simultaneously with rotation thereof in a manner moving the shell holding cavity into the firing position each rotation of the rotor means and for maintaining the cavity in the firing position for the preselected shell firing dwell time. The cavity defining means more preferably define two transversely spaced apart shell holding cavities, the chamber camming means being configured for causing each of the two shell holding cavities to move into the firing position during each revolution of the rotor means.

In order to provide the preselected firing dwell time of shells in the firing position, the chamber canning means are configured for causing a longitudinal axis of the shell holding cavity or cavities to trace out a preselected path, the cusp portion of the path corresponding to coincidence of the longitudinal cavity axis with the barrel bore axis so that rotation of the chamber without accompanying translation (radial movement) occurs for a short period of time, preferably about 10 milliseconds, corresponding to the firing dwell time. Preferably, but not necessarily, the path is generally cardioid-shaped. Operation of the gun is timed so that shell loading into the shell holding cavity or cavities occurs as the cavity or cavities are tracing other, non-cusp portions of the chamber path.

Shell guiding means are included in the rotor means for causing three dimensional shell movement from the shell feeding port to the shell firing position and for causing similar three dimensional casing movement from the shell firing position to the shell ejection port. The shell guiding means comprise generally helical shell and shell casing guides on inner-regions of the receiver, the shells and shell casings being caused by the guides to move in simultaneous rotational and longitudinal directions over at least part of their respective transport paths.

The rotor transverse aperture is preferably located centrally in relationship to the receiver shell feeding port and the casing ejection port so that shells are transported from the shell feeding port into the chamber shell holding cavity or cavities and fired shell casings are transported from the chamber cavity or cavities to the ejection port in a generally symmetrical manner so as to enable either selected one of the receiver ports to be used as a shell feeding port, with the other of the ports being correspondingly used as the casing ejection port. The ports are used for one pair of feeding/ejection functions for one direction of rotor rotation and are used for the opposite pair of functions for the opposite direction of rotor rotation.

Comprising the firing means are an elongate firing pin non-rotatably mounted in an aperture formed in the rotor rearwardly of the firing position so as to permit axially sliding movement of the firing pin between a rearwardmost, non-firing position and a forwardmost, firing position, and spring means for urging the firing pin towards the forwardmost position. Included are firing pin camming means responsive to rotation of the rotor for the firing pin to move to the rearwardmost position for most of the rotor rotation and for abruptly releasing the firing pin for forward movement wherever a chamber cavity moves into alignment with the shell firing position.

Efficient and birotational direction of operation of the gun is enabled by the use of cylindrical, rather than conventionally tapered and/or rimmed shells since the shells can be fed into and completely through the chamber cavities in either axial direction, according to rotor rotational direction, the shells stopping their axial movement only during the firing dwell time when a shell cavity is aligned with the firing position.

A shell magazine is preferably provided for the gun which has an unfired shell out-feed port and a fired shell casing in-feed port. Shell conveying means are included for feeding shells from the unfired shell out-feed port of the magazine to one of the receiver ports and for transporting fired shell casings from the other one of the receiver ports back to the casing in-feed port of the magazine. The shell conveying means comprise a first, endless loop shell conveyor communicating with both the shell out-feed port and the casing in-feed port of the magazine, a second conveyor for feeding shells from the first conveyor to the gun and a third conveyor for feeding fired shell casings from the gun back to the first conveyor. Guide or shell hand-off means are provided for causing, in response to movement of the first and second conveyors, the transfer of shells from the first conveyor to the second conveyor and for causing, in response to movement of the first and third conveyors, the transfer of shell casings from the third conveyor to the first conveyor. Feeder drive means drive the first, second and third conveyors in unison with one another and with the gun rotor during firing of the gun.

Preferably the longitudinal centers of the two receiver ports are longitudinally spaced apart from one another by about two shell lengths, the first, second and third conveyors being arranged in a mutual, side-by-side relationship with the second and third conveyors being on opposite sides of the first conveyor and in alignment with the receiver ports.

The three shell feeding conveyors are formed in endless loop form and the conveyor drive means are connected for driving all three conveyors in either direction according to which direction the rotor is driven in so that the gun can be operated in either rotational direction as may often be advantageous, particularly in gun systems using a pair of the guns in symmetrical, back-to-back relationship. In such a system one gun and its feeder is operated in one rotational direction and the other gun and its feeder is operated in the opposite rotational direction.

In order to match shell and casing pick up speeds, the conveyor means include means for increasing shell velocity by changing feeding movement of the second conveyor from linear to curvilinear movement and means for decreasing shell casing velocity by changing the feeding movement of the third conveyor from curvilinear to linear movement.

The present gun has a minimum of moving parts, in particular, sliding parts, and is comparatively simple in its construction. Abrupt stopping of parts, such as is experienced in most conventional guns when the bolt forwardly impacts the breech, is completely avoided, the reliability and life expectency of the gun accordingly being greatly enhanced.

BRIEF DESCRIPTION OF THE DRAWINGS

A better understanding of the present invention may be gained from a consideration of the following detailed description taken in conjunction with the accompanying drawings in which.

DESCRIPTION OF THE PREFERRED EMBODIMENT

Figure 1:
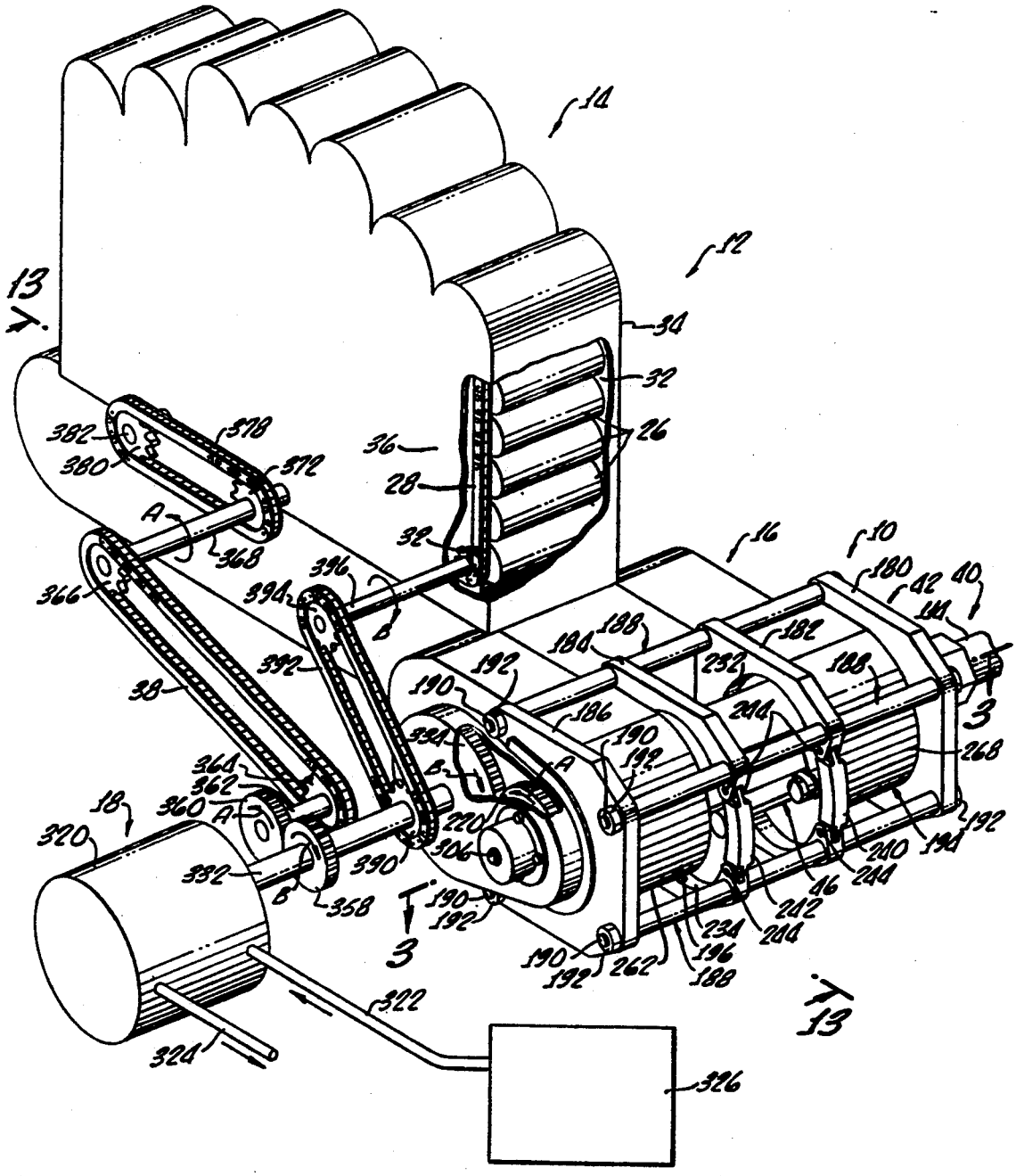
FIG. 1 is a partially cut-away perspective drawing showing the automatic gun according to the present invention and an associated shell feeder and shell magazine.

A rapid fire, automatic gun or cannon 10, in accordance with the present invention, is shown in FIG. 1 incorporated into an exemplary weapons system 12. Included in system 12, which may, for example, comprise an airborne gun system, are a shell magazine 14, a shell feeder 16 and drive means 18 for operatively driving gun 10, magazine 14 and feeder 16.

As more particularly described below, gun 10 is especially configured for firing telescoped ammunition having a uniform cylindrical shape. Magazine 14 and feeder 16 are similarly configured for storing and feeding such cylindrical, telescoped ammunition. For illustrative purposes, with no limitation intended or implied, gun 10 is disclosed herein as being of cannon calibre, particularly of about 25 mm size. It is, however, to be appreciated that gun 10 may be constructed in a wide range of calibres, as may be required for various different gun applications.

Also for illustrative purposes, according to exemplary weapon system 12, magazine 14 is disclosed herein as being of a linkless type in which a large number of shells 26 (in this case, telescoped cylindrical shells) are held in a closely packed, side-by-side relationship in an endless-loop conveyor 28. As depicted, conveyor 28 is generally ladder-like in configuration, with shells 26 being retained between transverse members 30 (see FIG. 13). A number of conveyor guides 32 which are of a sprocket type to be compatible with the flexible, "bicycle chain" configuration of conveyor 28, are rotatably mounted to respective magazine front and rear walls 34 and 36. Such guides restrain conveyor 28, which is entrained over the guides, to a convoluted, serpentine path through magazine 14. As a result of its closely folded path, conveyor 28 is relatively long so as to be capable of storing a large number of shells 26. During firing of gun 10, conveyor 28 is driven, by drive means 18, through a drive chain 38, in a shell advancing direction enabling feeder 16, which is also driven by drive means 18, to pick up shells 26 from the conveyor and transport them to gun 10 for firing.

Some automatic gun weapon systems require special provisions for disposing of fired shell casings. Shell casings ejected overboard from airborne weapons systems, for example, create a hazard to following, friendly aircraft whose engines may ingest the casings. To prevent damage by ejected shells, magazine 14 is preferably constructed also to store fired shell casings. Feeder 16 is, as more particularly described below, correspondingly configured for feeding fired shell casings from gun 10 back to magazine 14 for storage.

Figure 2:
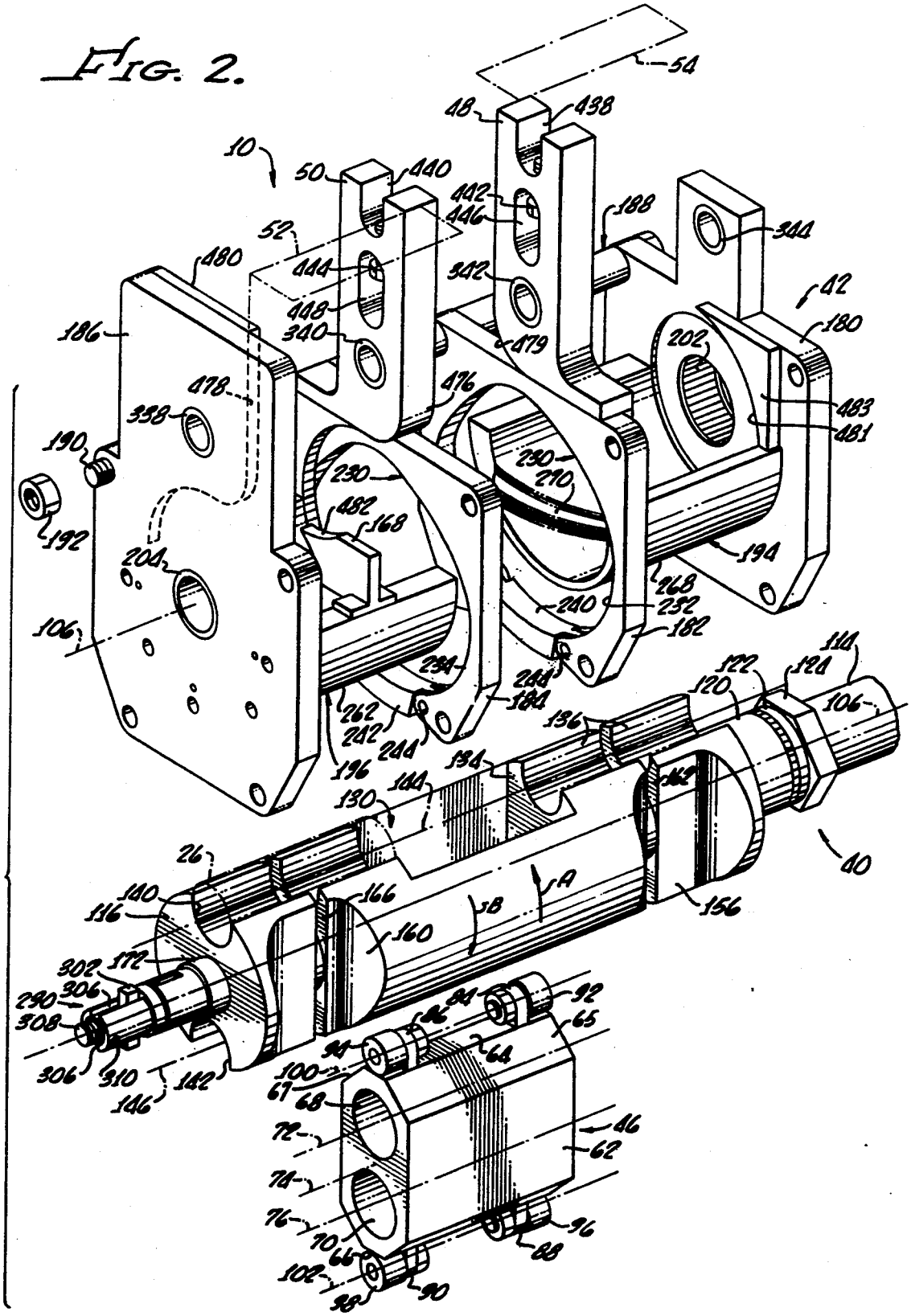
FIG. 2 is an exploded perspective drawing of the automatic gun of FIG. 1 (rotated through 90 degrees), showing principal parts thereof.

More specifically, and as is seen in FIG. 2, gun 10 is comprised generally of three major assemblies: a barrel assembly 40, a receiver assembly 42, and a chamber (or breech) assembly 46. Shown forming part of receiver assembly 42 are forward and rearward shell guide elements 48 and 50, respectively. Upon assembly (FIGS. 1 and 3), and as more particularly described below, chamber assembly 46 is mounted for radial sliding movement in rearward portions of barrel assembly 40, which is, in turn, rotatably mounted in receiver assembly 42. As described below, during firing, and according to the depicted counterclockwise direction of barrel assembly rotation (direction of Arrow "A"), shells 26 are fed into gun 10 around rearward guide 50, forwardly and around the inside of receiver assembly 42 and into chamber assembly 46 for firing, a rearward shell feeding "port" 52 being defined or located adjacent guide 50. After firing, fired shell casings are fed forwardly out of chamber assembly 46, along and around the inside of receiver assembly 42, and around forward guide 48, a forward casing ejection "port" 54 being defined or located adjacent to guide 48. Preferably, gun 10 is constructed for bidirectional rotation of barrel assembly 40 so that for opposite, clockwise rotation of barrel assembly 40 (direction of Arrow "B"), shells 26 are fed rearwardly into chamber assembly 46 from forward port 54 and fired shell casings are transported rearwardly and are ejected out of rearward port 52.

Described more particularly, chamber assembly 46 includes a strong, rigid metal chamber (or breech) 62, which is generally rectangular in shape but having at opposite ends 64, 66 converging opposite side-end regions, typically shown at 65 and 67. Formed longitudinally through chamber 62 are first and second, laterally spaced apart, cylindrical apertures or cavities 68 and 70, respectively, for holding shells 26 to be fired in gun 10, such apertures being therefore of substantially the same size as the shells. The axis 72 of first chamber aperture 68 is on one side of a central longitudinal axis 74 through chamber assembly 46 and the axis 76 of second aperture 70 is symmetrically located on the opposite side of chamber axis 74. All three axes 72, 74 and 76 are mutually parallel and lie in a common transverse plane of symmetry of chamber assembly 46. Length of chamber 62, and hence of shell holding apertures 68 and 70, is substantially the same as length of shells 26.

Figure 3:
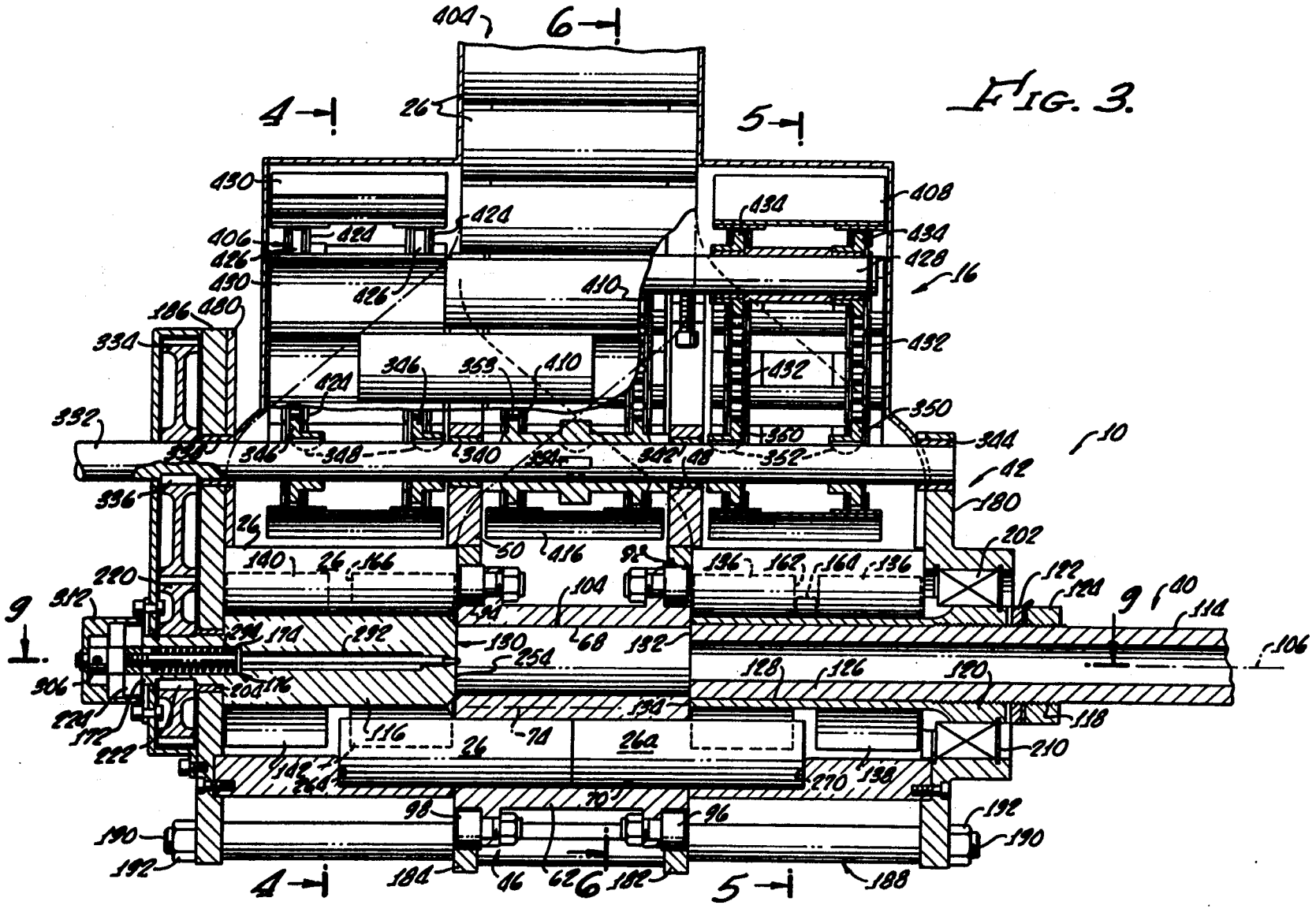
FIG. 3 is a partially cut-away, longitudinal cross-sectional view, taken along line 3—3 of FIG. 1, showing internal construction of the gun.

Projecting outwardly from the chamber end 64 disposed outboard of chamber aperture 68 are forward and rearward, longitudinally spaced apart camming lugs or ears 84 and 86, respectively. In a like manner, similar forward and rearward camming lugs 88 and 90 project outwardly from the opposite chamber end 66 outboard of aperture 70. Respectively mounted to lugs 84, 86, 88 and 90 are cam following rollers 92, 94, 96 and 98. Rotational axes 100 and 102 of respective roller pairs 92, 94, and 96, 98 are parallel to, and coplanar with, aperture and chamber axes 72, 74 and 76. As described below, cam following rollers 92, 94, 96 and 98 assist in enabling controlled rotational and radial movement, during firing of gun 10, of chamber assembly 46 in such a manner that first and second shell holding apertures 68 and 70 are alternately aligned or indexed into shell firing relationship with a shell firing position 104 defined along a barrel bore axis 106 (FIG. 3).

Barrel assembly 40 (FIGS. 2 and 3) comprises an elongate gun barrel 114 connected to a rotor 116, which may alternatively be considered as a barrel extension. To releasably connect barrel 114 to rotor 116, an externally threaded barrel region 118 is received into an internally threaded, forwardly projecting, castellated rotor region 120. A castellated locking ring 122 and nut 124 threaded on barrel region 118 enable non-rotatable locking of barrel 114 to rotor 116. When so connected, a substantial portion 126 of barrel 114 extends rearwardly into an axial, barrel receiving aperture 128 of rotor 116 to firing position 104.

Rotor 116 is formed to be generally cylindrical in shape, but has various cutouts as described below. Diameter of rotor 116 may be twice that of barrel 114. The longitudinal axis of rotor 116 is coincident with barrel bore axis 106, the barrel assembly rotating about such bore axis. A rectangular aperture 130 is formed transversely through central regions of rotor 116 (FIG. 2), aperture 130 being sized to slidingly receive chamber assembly 46 and permit transverse sliding movement thereof relative to the rotor since a radial plane of symmetry of aperture 130 passes through barrel bore axis 106. Sliding movement of chamber assembly 46 relative to rotor 116 is constrained to radial movement relative to bore axis 106. Upon assembly, barrel 114 is threaded into rotor 116 until a rearward barrel end 132 is flush with a forward end surface 134 of aperture 130 (FIG. 3). Firing position 104 is thus defined or located within rotor aperture 130 in rearward alignment with barrel end 132.

Figure 4:
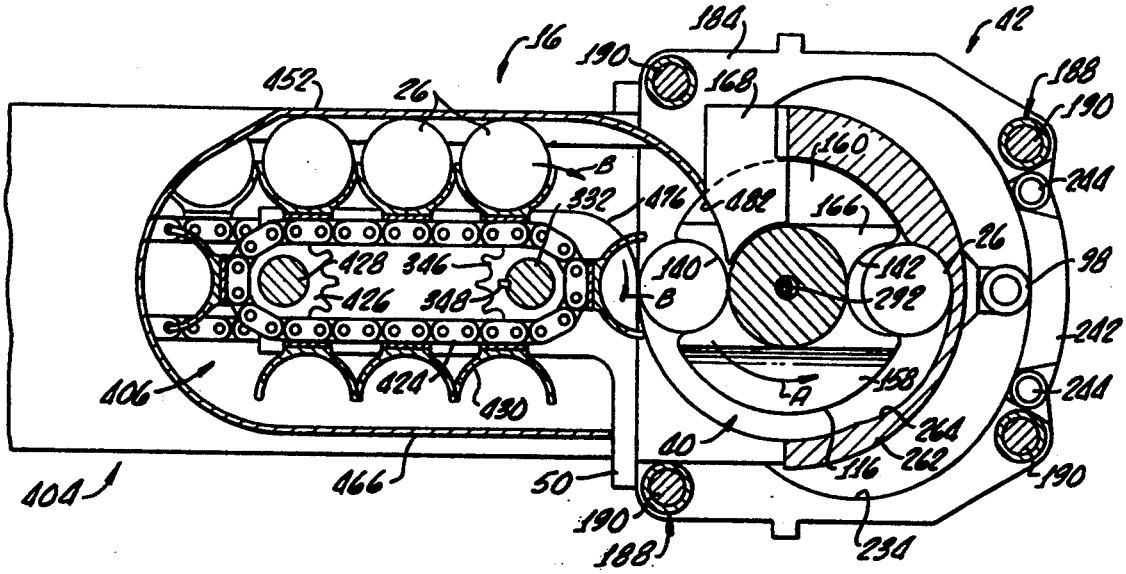
FIG. 4 is a rearward, transverse cross-sectional view, taken along line 4—4 of FIG. 3 and looking in the firing direction, showing internal portions of the gun and the loading path of unfired shells into the gun.

Semicylindrical, longitudinal shell holding recesses 136 and 138 are formed, 180 degrees apart, into the surface of rotor 116 forwardly adjacent to aperture 130 (FIGS. 2–5). Similar shell holding recesses 140 and 142 are formed, 180 degrees apart, into the rotor surface rearwardly adjacent to aperture 130, (FIGS. 2 and 4). Each of the four recesses 136, 138, 140 and 142 is substantially equal in length and diameter to the length and diameter of shells 26. Forward and rearward recesses 136 and 140, respectively, are on a common longitudinal axis 144 (FIG. 2) which is parallel to barrel bore axis 106 and in the radial plane of symmetry of rotor aperture 130. Similarly, forward and rearward recesses 138 and 142, respectively, are on a common longitudinal axis 146 which is also parallel to barrel bore axis 106 and is in the radial plane of rotor aperture symmetry. Rearward ends of forward apertures 136 and 138 and forward ends of rearward apertures 140 and 142 communicate with corresponding forward and rearward ends of rotor aperture 130 for shell and shell casing transferring as described below.

To reduce the weight and moment of inertia of rotor 116, peripheral side cutouts 154 and 156 (FIGS. 1 and 5) are made in rotor 116 between forward recesses 136 and 138. Similar peripheral side cutouts 158 and 160 (FIGS. 1 and 4) are made between forward recesses 140 and 142.

As shown in FIGS. 2 and 3, a narrow, radial groove 162 is formed peripherally around rotor 116 forwardly of chamber receiving aperture 130. This groove 162, which is formed in central regions of recesses 136, 138 and 154, 156, is configured for receiving a forward shell-guiding element 164 (FIG. 2). A groove 166 is formed peripherally around rotor 116 rearwardly of chamber receiving aperture 130 and in central regions of recesses 140, 142 and 158, 160 for receiving a rearward shell-guiding element 168. Shell-guiding elements 164 and 168 are more particularly described below.

Rotor 116 terminates at a rearward end in a reduced diameter, mounting end portion 172 (FIGS. 2 and 3). An elongate, stepped aperture 174 is formed forwardly into rotor 116, through end portion 172 and along barrel bore axis 106 to breech receiving aperture 130, for receiving a firing pin assembly 176, described below.

Receiver assembly 42, as shown in FIGS. 1-3, is constructed of four rigid, transverse plates and frames, which are a forward end plate 180, first and second intermediate frames 182 and 184, respectively, and a rearward end plate 186. Four spaced-apart, longitudinal rod and spacer assemblies 188, are used to keep end plates 180 and 186 and intermediate frames 182 and 184 in their required, longitudinal spaced apart relationship, rods 190 of the assemblies 188 passing through apertures formed through the end plates and intermediate frames. Eight lock nuts 192, which may be safety wired in a well known manner, are threaded onto ends of rods 190 to hold receiver assembly 42 together.

Extending between forward end plate 180 and first intermediate frame 182 are forward shell camming or guiding means 194. Similar, rearward shell camming or guiding means 196 extend between second intermediate frame 184 and rearward end plate 186. As more particularly described below, in response to counterclockwise rotation (direction of Arrow "A" and as viewed looking in the firing direction of gun 10) of barrel assembly 40, rearward shell camming means 196 cause, in conjunction with rotor 116 and guide 168, three dimensional movement of unfired shells from feed port 52 around rearward regions of the rotor and forwardly into chamber shell holding cavities 68 or 70. Simultaneously, forward shell camming means 194 cause, in conjunction with rotor 116 and guide 164, three dimensional movement of fired shell casings from chamber cavities 68 or 70 forwardly and around forward regions of the rotor to ejection port 54.

Preferably gun 10 is constructed in a manner that shell camming means 194 and 196, plates 164 and 168 and rotor 116, cause, in response to clockwise rotation of barrel assembly 40 (direction of Arrow "B"), unfired shells to be fed rearwardly from port 54 into chamber cavities 68 and 70 and fired shell casings to be fed rearwardly from the chamber cavities to the port 52. That is, gun 10 is preferably bidirectionally operable, the direction of shell feeding being dependent upon the direction of rotor rotation.

Rotatable mounting of barrel assembly 40 in receiver assembly 42 is by means of a forward bearing 202 installed in forward end plate 180 and a rearward bearing 204 installed in rearward plate 186 (FIG. 2). Upon assembly, rotor rearward end portion 172 is received into rearward bearing 204 and rotor forward region 120 is received into forward bearing assembly 204. Preferably, forward bearing assembly 202 includes roller and thrust bearings (not individually shown) so as to accommodate rearward axial loading caused by firing of gun 10. A snap ring 210 forwardly of bearing assembly 202 retains the assembly in position.

Also as shown in FIG. 3, a barrel assembly drive gear 220 is non-rotatably mounted on rotor rearward end portion 172 by a key 222 and is retained therein by a nut 224 which is threaded onto end portion 172.

The capability of gun 10 to feed and eject shells in response to rotation of barrel assembly 40 in either rotational direction is basically dependent upon the uniform cylindrical shape of telescoped shells 26, which enables the shells to be fed completely through chamber shell holding apertures 68 and 70 in either axial direction. Since, unlike that of conventional shells, the profile of shells 26 is the same before and after firing, insofar as shell and casing transporting is concerned, gun 10 does not "see" any difference between unfired and fired shells.

Control of radial sliding movement of chamber assembly 46 in rotor aperture 130, while barrel assembly 40 is rotating in receiver assembly 42, so as to alternately align chamber cavities 68 and 70 with shell firing position 104 and to enable loading of the cavities when they are out of alignment with the firing position, is enabled by chamber camming means 230. Comprising canning means 230 are identical forward and rearward inner peripheral camming surfaces 232 and 234, respectively, which are formed around, and define somewhat circular, rotor clearance openings through, frames 182 and 184. Further comprising chamber camming means 230 are the above described cam follower rollers 92, 94, 96 and 98 mounted on chamber 62.

Accordingly, receiver intermediate frames 182 and 184 and the two opposing pairs of chamber rollers 92, 96 and 94, 98 are longitudinally spaced apart the same distance so that forward rollers 92 and 96 roll along forward surface 232 and rearward rollers 94 and 98roll along rearward surface 234. As described below, camming surfaces 232 and 234 are configured relative to chamber assembly 46, so that, for any rotational position of barrel assembly 40 (and hence, chamber assembly 46), the chamber rollers 92, 94, 96 and 98 remain in rolling contact with the camming surfaces.

Figure 6:
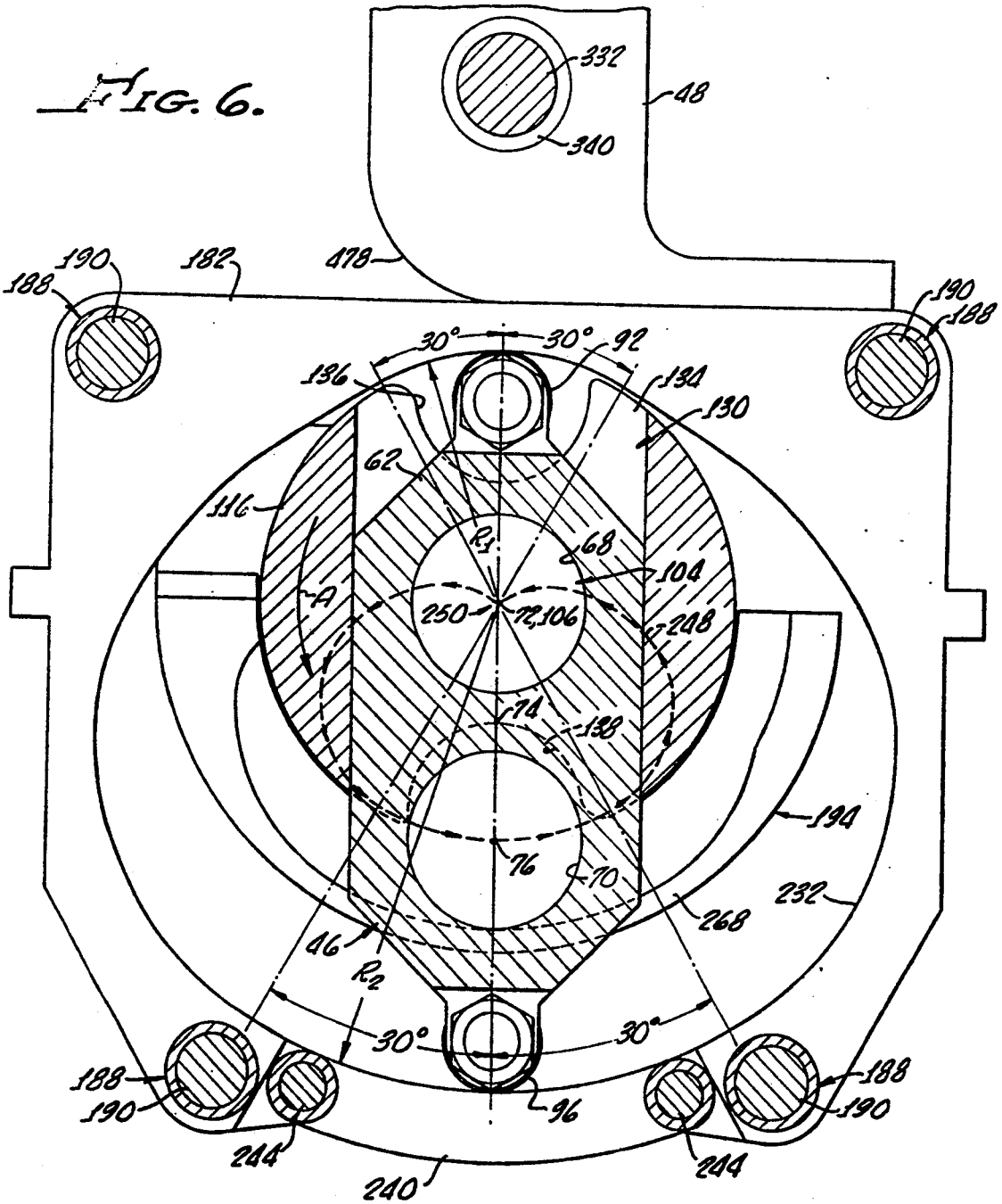
FIG. 6 is a central, transverse cross-sectional view, taken along line 6—6 of FIG. 3 and looking in the firing direction, showing the chamber assembly and shell holding cavity cardioid path.

During firing of gun 10 and in response to rotation of barrel assembly 40 and chamber assembly 46, receiver camming surfaces 232 and 234 and chamber rollers 92, 94, 96 and 98 cooperate to cause the rotating chamber assembly to slide radially in rotor aperture 130. The combined rotational and sliding motion of chamber assembly 42 causes respective axes 72 and 76 of chamber shell holding apertures 68 and 70 alternately to trace out a repetitive, predetermined path, shown in dashed lines and identified by reference number 248 in FIG. 6. As shown in FIG. 6, configuration of receiver camming surfaces 232 and 234 is selected so that path 248 has a "cusp" point 250 which coincides with alignment of chamber axes 72 and 76 with barrel bore axis 106. Stated otherwise, at the cusp point 250 of path 248, one or the other of the chamber apertures 68 and 70, and any shell 26 held therein, is in firing position 104 and is aligned with barrel 114 for shell firing.

It is to be appreciated that at cusp point 250 of path 248, chamber 62 rotates for a brief period of time with rotor 116 and barrel 114 with no concurrent radial movement. During this brief period of time, a shell 26 in the aligned chamber aperture 68 or 70 remains stationary relative to barrel 114. Such time period is defined herein as the "firing dwell time", and path 248 is selected so as to provide about 10 milliseconds of dwell time, as is ordinarily more than sufficient to allow for initiation of shell firing and substantially complete propellant buring.

Preferably, and as is shown in FIG. 6, chamber path 248 is of cardioid shape, as is well known in mathematics. However, path 248 may be otherwise shaped so long as the path has a cusp point 250 coincident with barrel bore axis 106.

In order to provide the necessary firing dwell time during which chamber 62 rotates with rotor 116 without any radial movement relative thereto, the opposing pairs of chamber rollers 92, 94 and 96, 98 are required to roll along constant radius portions of the intermediate frame camming surfaces 232 and 234 for a part of each rotor revolution. Accordingly, as partially shown in FIG. 6, for axis 72 of chamber aperture 68 to dwell briefly at barrel bore axis 106, the pair of chamber rollers 92, 94, rolls along a region of camming surfaces 232 and 234 having a constant radius "$R_1$". At the same time, the opposing pair of chamber rollers 96 and 98 rolls along opposite regions of surfaces 232 and 234 which have a larger constant radius "$R_2$". It can be seen from FIG. 6 that radius $R_1$ is equal to the distance from either of the chamber aperture axes 72 or 76 to the outer peripheral surface of the closest pair of cam rollers 92, 94 or 96, 98 and that the radius $R_2$ is equal to the distance from such axes to outer peripheral surfaces of the remote pair of cam rollers.

It has been determined that to provide a firing dwell time of about 10 milliseconds, at a typical rotational rate of 1000 RPM, the constant, $R_1$, $R_2$ radius portions of camming surfaces 232 and 234 should each be about 60 degrees of arc and should preferably extend about 30 degrees of arc on each side of a vertical plane (for the orientation of FIG. 6) of symmetry through barrel bore axis 106.

Camming surfaces 232 and 234, as shown, are shaped to have smooth, arcuate transition regions between the regions of constant radius $R_1$, $R_2$. Since the $R_1$, $R_2$ regions each are about 60 degrees of arc length, the connecting intermediate regions are each about 120 degrees of arc length.

For the described configuration of camming surfaces 232 and 234, it can also be seen from FIG. 6 that when either of the chamber aperture axes 72 and 76 is coincident with barrel bore axis 106, the other chamber aperture axis is at a maximum distance, which is equal to the distance $R_2$–$R_1$, out of alignment with the barrel bore axis. This maximum, $R_2$–$R_1$, distance is established by appropriate selection of $R_1$ and $R_2$ to enable loading of shells 26 into, and the removal of fired shell casings (identified, for example, in FIG. 5 by the reference No. **26*a*) from, the chamber apertures 68 and 70 during travel of the aperture axes 72 and 76 along path 248, when the axes are out of alignment with the barrel bore axis 106 and the apertures 68 and 70 are unobstructed, that is, when the apertures 68 and 70 are aligned partially or fully with rotor shell holding recesses 136, 138, 140 or 142**.

Rapid, easy replacement of chamber assembly 42, without substantial disassembly of gun 10, is enabled by constructing receiver intermediate frames 182 and 184 to have short, removable sections 240 and 242, respectively, which are on the side of receiver opposite shell ports 52 and 54 (FIGS. 1, 2 and 6). Two pins 244 are used to connect each of removable sections 240 and 242 to its respective frame 182 or 184. Length of sections 240 and 242 is made sufficiently long to permit passage of chamber assembly 46 through the frame openings provided when the sections are removed. Chamber camming surfaces 232 and 234 continue completely around the inner periphery of intermediate frames 182 and 184, including sections 240 and 242.

Chamber shell holding apertures 68 and 70, in fact, form actual firing chambers in which shells 26 are fired (by firing pin assembly 176) when the chamber apertures are moved into firing position 104. To be compatible with gun 10, shells 26 are constructed having axially expandable, annular end seals (not shown). Upon firing, combustion gases force these shell end seals into tight, gas-sealing contact with adjacent barrel rearward end surface 132 and rotor aperture rear wall 254 (FIG. 3). Because, during the firing dwell time, no relative motion occurs between shells held in chamber apertures 68 and 70, and barrel 114 and rotor 116, there are no inherent problems with such shell-to-barrel and shell-to-receiver wall sealing. Towards the end. of the firing dwell time, gas pressure from the just-fired shell will have been sufficiently reduced to permit the shell end seals to self-retract, thereby enabling unimpeded sliding movement of the shell, still in aperture 68 or 70, out of firing position 104.

Shells 26, because they are of a uniform cylindrical shape, pass completely through chamber apertures 68 and 70 during gun operation, feeding of an unfired shell 26 into one axial end of chamber apertures 68 or 70 pushing shell casing **26*a*** of a previously fired shell out the opposite axial end of the apertures. Both shell feeding and casing ejection are always in a common axial direction and, as a result, shell feeding and ejection operations are very smooth and can be performed in a very rapid manner.

When chamber aperture path 248 is established in the above-described manner, and after firing dwell time and corresponding barrel assembly rotational angle have been selected, shell feeding and casing ejection paths are developed and timed. In regard to the shell feeding path, the initial feeding point (in-feed port 52) is fixed, relative to chamber assembly 46. For fired shell casings **26*a* the ejection point (ejection port 54) is similarly fixed. Position of these gun ports 52 and 54 is largely determined by configuration of feeding means 16 (FIGS. 1, 4 and 5**); conversely, location of these gun ports determines output configuration of the feeding means.

The in-feed port 52 and ejection port 54 in the embodiment of the gun illustrated in the drawings are better viewed as the in-feed position and ejection position relative to the other gun components. These positions, 52, 54, are the ammunition entrance and exit paths into and out of the receiver assembly 42 defined by the elements of the receiver and the interpositioning therewith of the ammunition conveyors 406 and 408. This is best understood by reference to FIGS. 2 and 3. As shown in FIG. 3, the in-feed ultimate location is at the terminus of the pair of phantom lines extending downwardly from the conveyor 404, and the ejection position is at the terminus of the pair of dashed lines also extending downwardly from the conveyor 404.

For the illustrative feeder configuration, in which provision is made for transferring shells 26 from magazine 14 to gun 10 and for simultaneously transferring fired shell casings 26*a* back from the gun to the magazine, gun ports 52 and 54 are longitudinally and laterally offset relative to one another. These longitudinal and lateral offsets are preferably symmetrical about a plane through barrel bore axis 106 and through feeder 16 (a horizontal plane for the gun orientation of FIGS. 1, 4 and 5) and about a second plane, orthogonal to the first-mentioned plane, through the longitudinal center of chamber assembly 46. As seen from FIG. 3, ports 52 and 54 are separated in an axial direction by a distance equal to about one shell length; lateral separation distance between ports 52 and 54, (FIGS. 4 and 5) is equal to about one shell diameter.

Since unfired shells 26 are required to move from feed port 52 into chamber apertures 68 and 70 for firing, the shells have to travel a helical path extending from port 52 partially around the inside of receiver assembly 42 and forwardly about one shell length into chamber apertures 68 and 70. As described below, some radial movement of the shells is also provided to accommodate radial movement of chamber assembly 42 during its feeding cycles. Three dimensional, helical movement of fired shell casings 26*a* from chamber apertures 68 and 70 to ejection port 54 is similarly provided to enable ejection of fired casings and/or of shells which have failed to fire.

Figure 7:
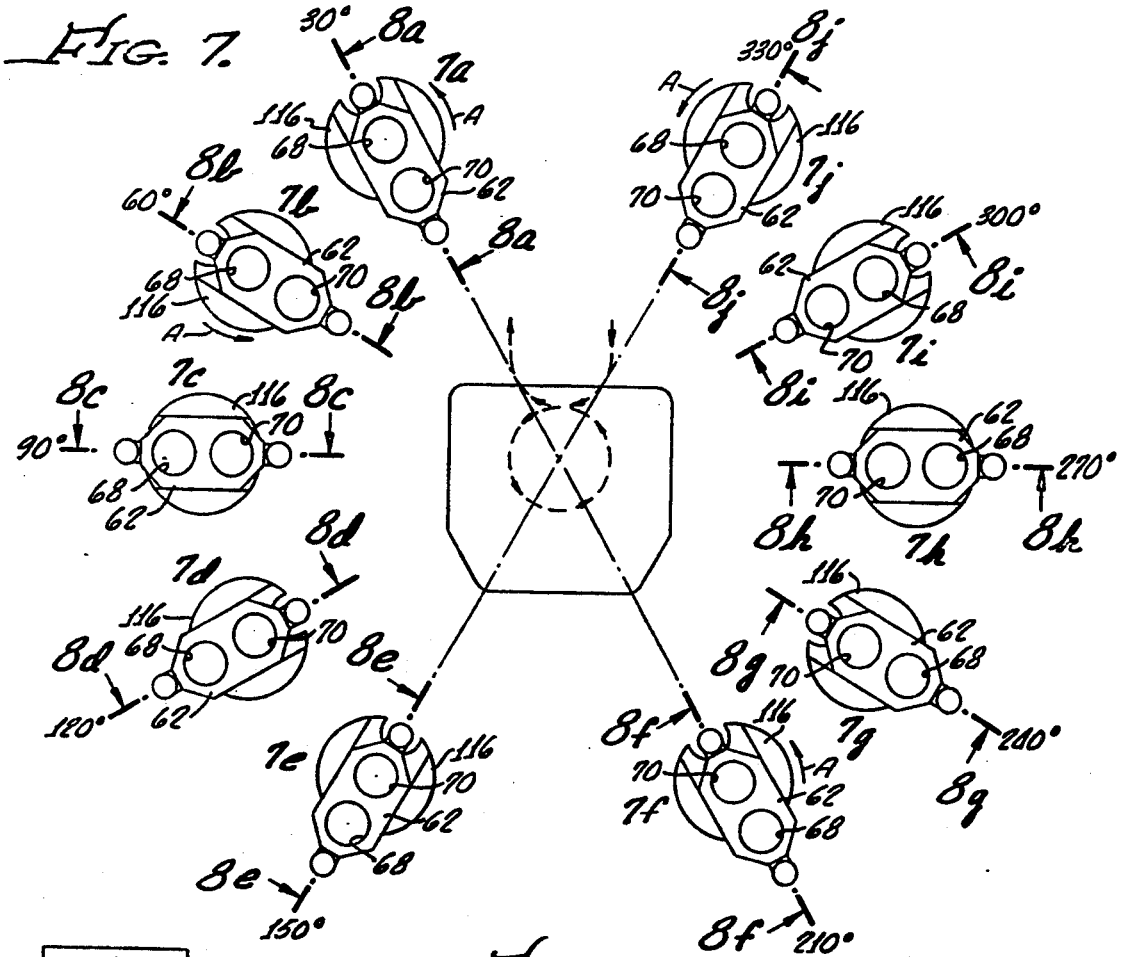
FIG. 7 is a pictorial diagram showing, for a complete 360 degrees rotation of barrel assembly, positioning of chamber assembly, and particularly of chamber shell holding apertures, relative to the barrel bore axis, FIGS. *7a–7j* showing such positioning for respective rotational angles of 30 degrees, 60 degrees, 90 degrees, 120 degrees, 150 degrees, 210 degrees, 240 degrees, 270 degrees, 300 degrees and 330 degrees, firing cycles being shown between 150 degrees–210 degrees (FIGS. *7e, 7f*) and between 330 degrees–30 degrees (FIGS. *7j–7a*), and loading cycles being shown between 120 degrees–240 degrees (FIGS. *7d–7g*) and between 300 degrees and 60 degrees (FIGS. *7i–7b*)
Figure 8:
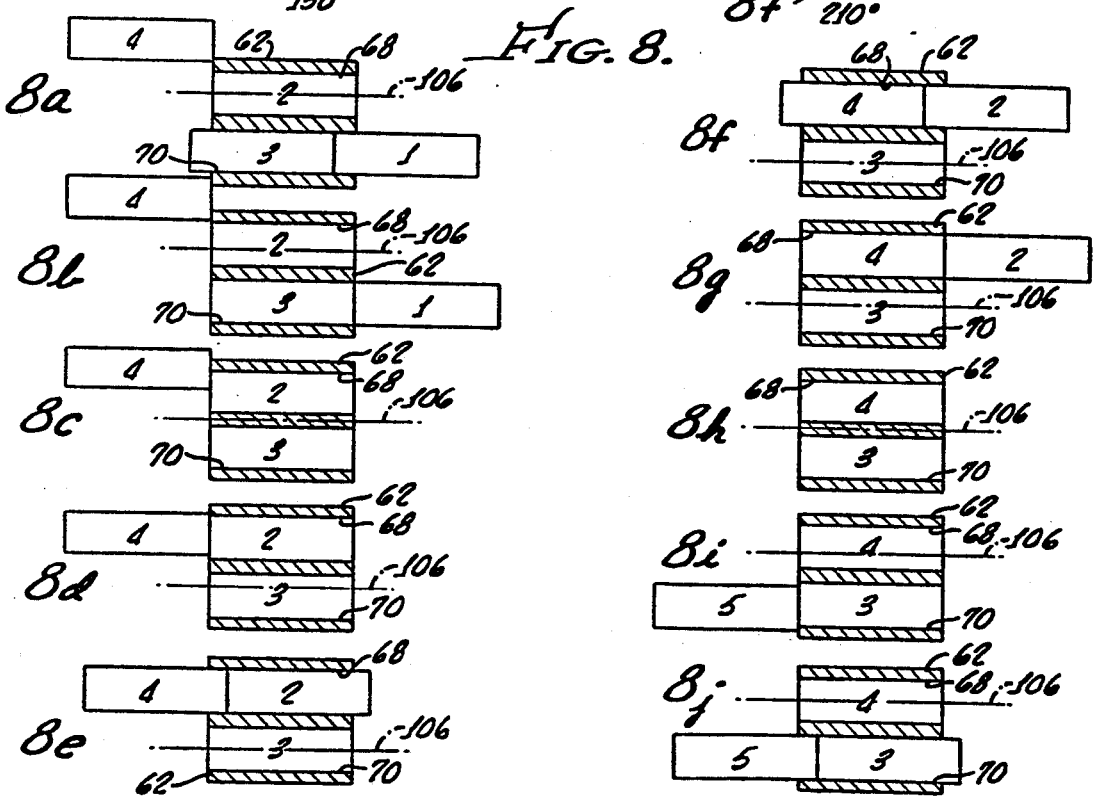
FIG. 8 is a pictorial diagram showing, in a series of longitudinal cross sections, shell loading, firing and fired casing ejection as relates to the chamber shell holding apertures, FIGS. *8a–8j* being taken along respective lines *8a—8a* through *8j—8j* of FIGS. *7a–7j;*

Illustrative, 120 degree shell loading and casing ejection cycles are depicted in FIG. 7. Each 120 degree loading/ejection cycle occurs during one third of a revolution of barrel assembly 46 and is centered relative to a 60 degree shell firing cycle. As depicted, the 120 degree loading cycle of each chamber aperture 68 and 70 leads the firing cycle of the same aperture such that centers of the loading and firing cycles for each chamber aperture 68 and 70 are 180 degrees out of phase. Preferably the 120 degrees loading cycle of one chamber aperture 68 or 70 is centered in respect to the 60 degree firing cycle of the other chamber aperture. Accordingly, one chamber aperture 68 or 70 is being loaded while a shell in the other aperture is being fired. As described below, casing ejection is initiated by shell loading, the shell being loaded into the apertures 68 or 70 pushing casing 26*a* of a previously fired shell through and out the aperture. For convenience, the 120 degree loading cycle of chamber aperture 70 (No. 2 aperture) and the 60 degree firing cycle of the aperture 68 (No. 1 aperture) are depicted as being centered at 0 degrees of rotor rotation, the other feeding and firing cycles accordingly being centered at 180 degrees of rotation. FIGS. 7 and 8 make it apparent that each chamber aperture 68 and 70 is loaded and fired once each revolution of barrel assembly 40, the firing rate of gun 10 being thereby equal to the rotational rate of the barrel assembly multiplied by the number of shell holding apertures provided in chamber assembly 46. Assuming barrel assembly 40 is driven at a rotational rate of 1000 RPM, the illustrated double-apertured chamber assembly 46 provides a firing rate of 2000 rounds per minute.

Figure 5:
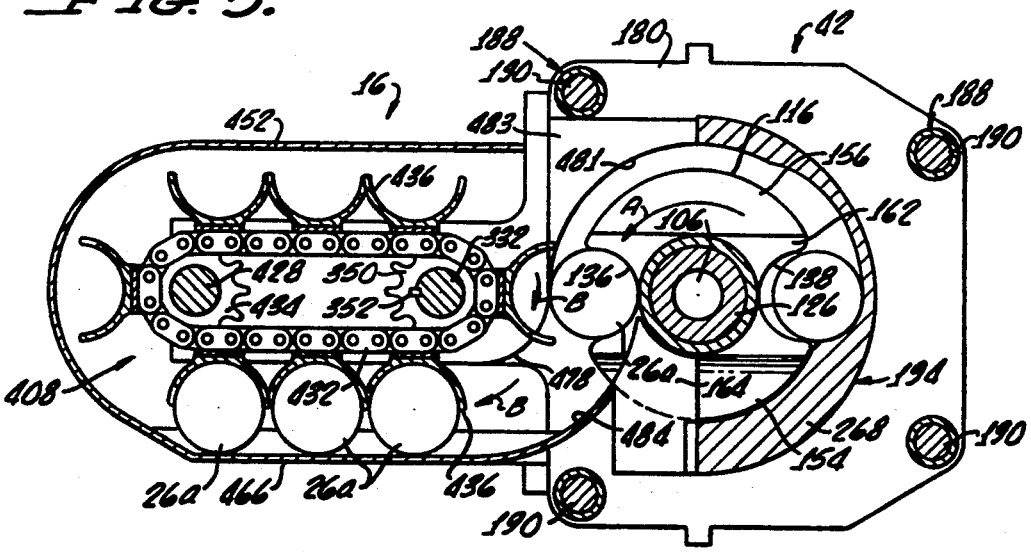
FIG. 5 is a forward, transverse cross-sectional view, taken along line 5—5 of FIG. 3, and looking in the firing direction, showing internal portions of the gun and the ejection path of fired shell casings from the gun.

As shown in FIGS. 4–6, shells 26 are fed by feeding means 16 into rotor rearward shell-holding recesses 140 and 142 (for rotor rotation in direction of Arrow "A") and are angularly transported around the inside of receiver assembly 42 by the rotation of barrel assembly 40. During such rotational transport of shells 26, the shells are restrained in rotor recesses 140 and 142 by adjacent inner regions of receiver assembly 42. Fired shell casings 26*a* are similarly angularly transported (for the same direction of rotor rotation), being fed from chamber apertures 68 and 70 into rotor forward shell-holding recesses 136 and 138.

In regard to such rotational transport of shells 26 and casings 26*a*, it is emphasized that rotor shell-holding recesses 140, 142, and 136, 138 are always in the same plane as chamber shell-holding apertures 68 and 70. This is because barrel assembly 40 (including rotor 116) and chamber assembly 46 are constrained as above-described, always to rotate in unison. Therefore, the principal attention in respect to feeding shells 26 from feed port 52 to chamber apertures 68 and 70 and to feeding shell casings 26*a* from the chamber apertures to ejection port 54 is necessarily directed to the longitudinal (axial) movement of the shells and casings. Attention is also directed to the radial movement of shells 26 to the extent needed to move,the shells partly out of rotor recesses 140 and 142 into radial alignment with apertures 68 and 70 of the radially sliding chamber assembly 46. Similar provision, also described below, is provided to enable radial movement of shell casings 26*a* radially inwardly from chamber apertures 68 and 70 into a full seating relationship in rotor forward shell-holding recesses 136 and 138.

Accordingly, rearward shell camming means 196 control and guide longitudinal and radial movement of shells 26 from feed port 52 into chamber apertures 68 and 70 in response to the above-described rotational movement of the shells by barrel assembly 40. Similar, forward shell camming means 194 control and guide longitudinal and radial movement of shell casings 26*a* from chamber apertures 68 and 70 to ejection port 54 in response to the above-described rotational movement of the casings by barrel assembly 40.

Figure 9:
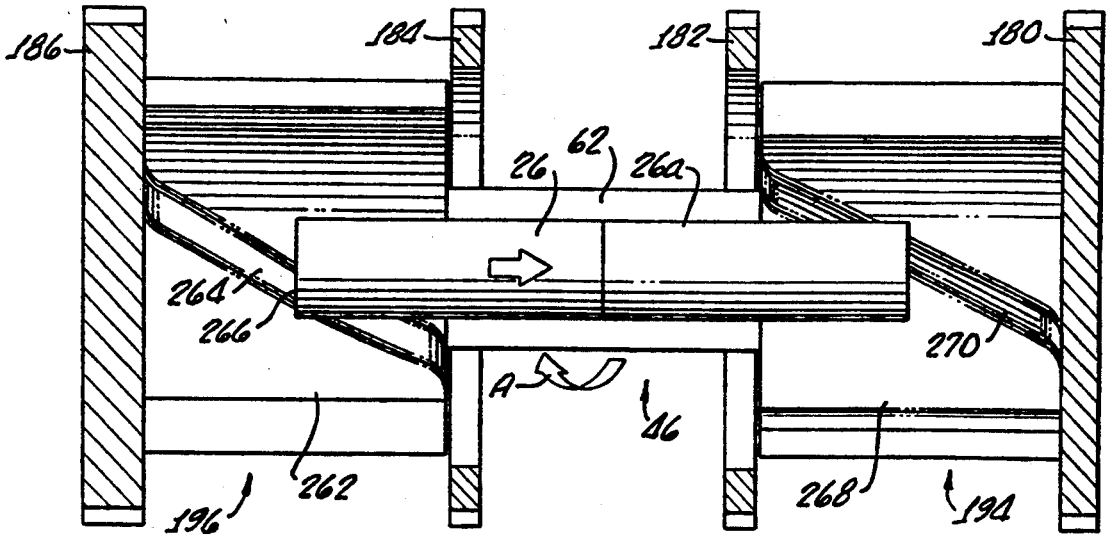
FIG. 9 is a pictorial cross sectional taken along line 9—9 of FIG. 3 showing shell camming means for causing forward shell feeding and shell case ejection movement.

Rearward shell camming means 196, as shown in FIGS. 2, 4 and 9, comprise a longitudinal shell camming member 262 fixed between receiver assembly rear plate 186 and receiver intermediate frame 184. Camming member 262, which is in the form of a hollow, semicylinder or half tube, is fixed to plate 186 and frame 184 remote from feed port 52 and, in the gun orientation of FIG. 2, between lower regions of the plate and frame. Formed or defined around the inside of camming member 262 is a generally helical, shell camming surface 264. Such camming surface 264 extends radially inwardly towards barrel bore axis a distance sufficient to be engaged by a rearward end 266 of a shell 26 retained in rotor recesses 140 or 142 (FIG. 9). Since camming member 262 is fixed to receiver end plate 182 and frame member 184, camming surface 264 is fixed relative to receiver assembly 42. Therefore, barrel assembly 40 rotates, during firing operation of gun 10, relative to camming surface 264.

As barrel assembly 40 rotates with a shell 26 retained in rotor recesses 140 or 142, rearward shell end 266 continually engages camming surface 264 and is pushed longitudinally forwardly thereby into whichever one of the chamber apertures 68 or 70 lies along the shell's forward path.

Figure 10:
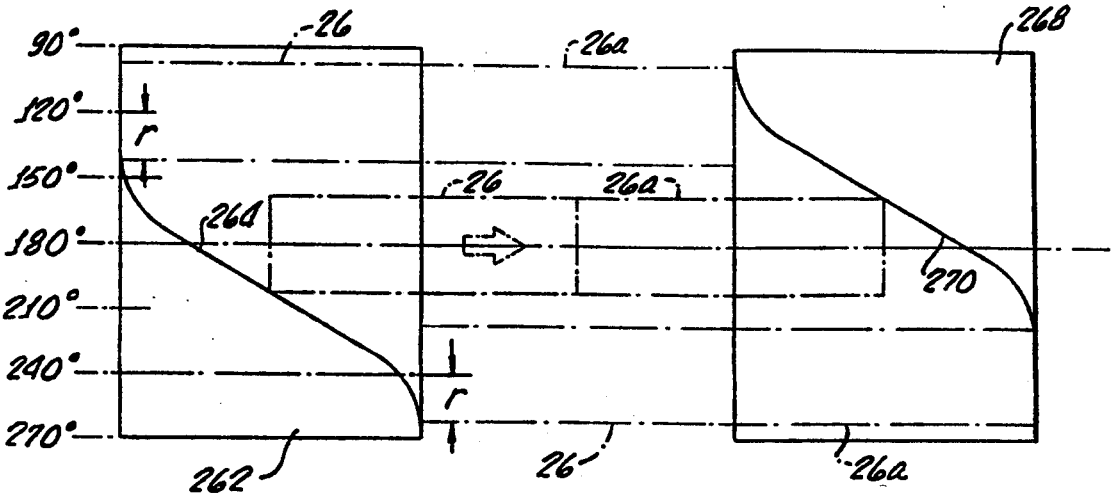
FIG. 10 is a diagram showing the developmental layout of the camming surfaces depicted in FIG. 9.

Layout development of camming surface 264 is shown in FIG. 10. As previously discussed, the shell loading (casing ejection) cycle occurs over 120 degrees of chamber rotation and is centered at 0 degrees and 180 degrees relative to chamber rotation. That is, one of chamber apertures 68 and 70 is loaded every 180 degrees of chamber and barrel assembly rotation. However, such shell loading into chamber apertures 68 and 70 always occurs at the same position relative to receiver assembly 42, and hence at the same place relative to camming surface 264. As a result, only one camming surface 264 is required, each of the two shell-holding recesses 140 and 142 sweeping by the camming surface 264 once every 360 degree rotation of barrel assembly 40. With each such sweeping pass by camming surface 264, a shell 26 held in rotor recess 140 or 142 is pushed forwardly, by engagement with surface 264, into the corresponding one of the two chamber apertures 68 and 70 for firing when the shell is subsequently moved by radial movement of chamber assembly 46 relative to the barrel assembly to firing position 104.

As discussed above and shown in FIG. 7, shell loading into chamber apertures 68 and 70 is accomplished over 120 degrees of chamber revolution and occurs at 180 degrees rotational intervals, the latter being equivalent to rotor recesses sweeping camming surface 264 twice each rotor revolution. Camming surface 264 is developed accordingly, as depicted in FIG. 10, with the 120 degree loading cycle being centered about 180 degrees.

Forward movement of a shell 26 held in one of the rotor recesses 140 or 142 just starts as the particular rotor recess reaches the 120 degree rotational position at which shell end region 266 starts engaging camming surface 264. As rotation of the shell 26 (held in rotor recess 140 or 142) continues, the shell is pushed forwardly by surface 264 into one of the chamber recesses 68 or 70. After an additional 60 degrees of travel (that is, when at the 180 degree position) the shell is pushed by surface 264 halfway into the chamber aperture 68 or 70 and any shell casing **26*a* (or shell 26) already contained in the chamber aperture is pushed halfway out by the in-feeding shell 26. When, after an additional 60 degrees of rotation, the shell 26 reaches the 240 degree position, the shell has been pushed forwardly by surface 268 completely into the chamber aperture 68 or 70**, thereby completely pushing out of the aperture any casing or shell already in the aperture.

Camming surface 264 is accordingly layed out in a flat "S" shape, as seen when flattened out (FIG. 10), the helical surface starting its curvature at one shell radius, "r" after the 120 degree point and ending its curvature one shell radius, "r", after the 240 degree point. Surface 264 is preferably smoothly shaped between these extremes so as to provide the same rate of change of curvature when the surface is traversed in either axial direction.

Although the ejection path of casings **26*a* from chamger apertures 68 or 70 to ejection port 54 does not necessarily have to be similar to the above-described shell feeding path, established by camming surface 264, a similarly shaped path is preferred so that gun 10 can be operated in either rotational direction with the same operational characteristics. In this regard, it is to be appreciated that the feeding and ejection paths for one direction of rotating barrel assembly 40 become, respectively, the ejection and feeding paths for the opposite direction of rotation. Moreover, symmetrical location of feed and ejection ports 52 and 54** relative to firing position dictate symmetry of the three-dimensional feeding and ejection paths.

Forward shell camming means 194 accordingly comprise a casing cammming member 268 fixed between receiver forward intermediate frame 182 and forward end plate 182 (FIGS. 2, 9 and 10). Casing camming member 268 is generally shaped like shell camming member 262, having a helical, casing camming surface 270 which is generally shaped like shell camming surface 264. The particular difference between shell camming member 262 and casing ejection member 268 is a result of shells 26 being first rotated from 0 degrees to 120 degrees then rotated and pushed forwardly for the next 120 degree, whereas, shell casings **26*a* are rotated and pushed forwardly from 120 degrees to 240 degrees and are then rotated the next 120 degrees to ejection port 54. Therefore, shell and casing camming surfaces 264 and 270** are neither symmetrical nor mirror images of one another, but rather can be considered as being complimentary to one another.

Casing camming surface 270 is, however, layed out as above-described for shell camming surface 264, with surface 270 starting a shell radius before the 120 degree point and ending a shell radius after the 240 degree point (FIG. 10).

Inasmuch as the shell loading/casing unloading cycle, as described, requires 120 degrees of arc and the overlapped firing cycle, during which no chamber radial movement occurs, requires only 60 degrees of arc, beginning and end portions of the shell loading/casing unloading cycle occur while the chamber apertures 68 and 70 are moving radially relative to rotor shell holding cavities 140, 142 and 136, 138. Therefore, shells 26 and shell casings **26*a* require some radial movement as they are being angularly and forwardly transported so that the shells and casings stay in alignment with the chamber apertures 68 and 70 throughout the entire 120 degree loading/ejecting cycle. While necessity for such radial movement of shells 26 and casings 26*a* could be avoided by making the overlapping feeding and firing cycles of equal arc length and to be exactly coincidental, and also by making rotor 116 and chamber assembly 46 of such relative sizes that at the loading/extracting cycle positions of chamber apertures 68 and 70 are exactly aligned with rotor recesses 136, 138 and 140, 142, such does not necessarily provide for optimum gun design. Alternatively, as shown in FIG. 7** and as described herein, it may be preferable to provide some radial shell/casing movement while optimizing the feeding/ejecting and firing cycles.

Rearward, shell camming means 196 are consequently configured to permit the amount of radial shell movement necessary to maintain alignment of a shell 26 being fed into chamber apertures 68 or 70 with such apertures so that no shell jamming occurs during chamber loading. Inasmuch as centrifugal forces resulting from shell angular transporting by rotating barrel assembly acts in a direction forcing the shell radially outwardly, camming means 196 are additionally contoured to permit that radial outward movement of the shells 26 required to maintain shell-chamber aperture alignment during shell insertion. Such additional contouring is considered when developing the contour of camming surface 264 (FIGS. 9 and 10 and, as above-stated, is entirely dependent upon the ordinarily small amount of radial movement (if any) required to maintain shell-chamber aperture alignment during shell insertion.

Forward casing camming means 194 is similarly configured to cause radial inward movement of casings 26*a* during "extraction" of the casings from the chamber apertures 68 or 70. Such contouring of camming means 194 pushing shells radially inwardly, against centrifugal forces pushing the casings radially outwardly, the ordinarily small amount required to maintain casing—chamber aperture alignment during casing extraction.

Figure 11:
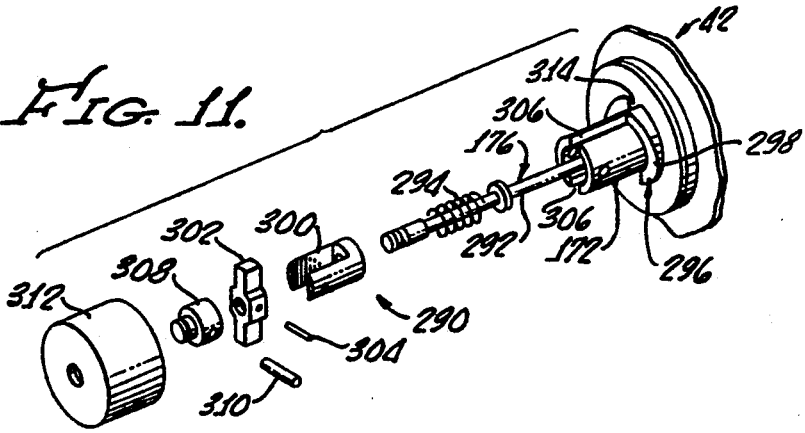
FIG. 11 is an exploded perspective showing construction of the firing means.

Cam operated shell firing means 290 are provided for firing shells 26 when the shells are moved (in chamber apertures 68 and 70) into firing position 104. As shown in FIGS. 3 and 11, firing means 290 include firing pin assembly 176 which, in turn, comprises firing pin 292 and compression spring 294. A circular cam 296, having an annular, rearward facing camming surface 298, is fixed to a rearward end of receiver assembly 42 so as to be stationary in respect thereto. Camming surface 298 is double ramp shaped with abrupt steps at the 150 degree and 330 degree shell firing positions (FIG. 7).

A clevis 300 fits over the rearward end of firing pin 292, rearwardly of spring 294. A cam follower 302, having sidewardly projecting arms, is pinned, by a pin 304 within clevis 300 and to firing pin 292. Cam follower 302 fits within slots 306 formed in rearward end portion 172 of rotor 116, clevis 300 fitting within a recessed area of such rotor rearward end. An end cap 308 fixed to rotor rearward end portion 172 by a pin 310 retains firing pin assembly 176, 300 and cam follower 302 in rotor 116. A cover 312 protects otherwise exposed portions as firing means 290.

Because cam follower 302 is constrained in rotor slots 306, the follower rotates with rotor 116. However, slots 306 enable axial movement of such cam follower as it slides along cam surface 296. As cam follower 302 ramps up cam surface, in response to rotor rotation relative to receiver assembly 42, firing pin 292 is moved rearwardly, against spring 294, to a rearwardmost, non-firing position. However, as rotor 116 further rotates to the 150 degree firing position, cam follower 302 drops off an abrupt camming surface step 314, spring 294 thereupon driving firing pin 292 forwardly to a forwardmost, firing position which causes firing of a shell 26 in firing position 104. Continued rotation of rotor 116 causes cam follower 302 to ramp up the second ramp portion of camming surface 248. At the second, 330 degree firing position, cam follower 302 drops off the second one of camming surface steps 314 and firing pin 176 is again released to cause firing of a next shell 26 held in the other chamber cavity 68 or 70.

Shell loading, firing and casing unloading has been above-described as being responsive to rotation of barrel assembly 40 by driving means 18. For the illustrative gun system 12 shown in FIG. 1, magazine 14 and shell feeder 16 are also driven by driving means 18.

As shown, driving means 18 comprise a prime mover 320 which may, for illustrative gun system 12, comprise an air or gas motor. Shown connected to air motor 320 is a pressurized air inlet line 322 and an air vent or discharge line 324. Pressurized air is supplied to motor 320, via inlet line 322, from a source 326 of high pressure air, for example, a compressor.

If air pressure source 326 is external to gun 10, the gun would be considered an externally operated gun, operation being independent of actual firing of the gun. On the other hand, if pressure source 326, is in fact, barrel 116 of gun 10, the pressurized gas being supplied to motor 320 as a product of shell firing, the gun would be self-powered, with operation dependent upon firing of the gun. Alternatively, as may be preferred for some systems, gun 10 could be a hybrid externally/self-powered gun, utilizing external pressurized air (or gas) source 326 to drive gun system 12 up to fast operating speed, at which time, pressurized gases from firing would be used to supplant or augment the external source of pressurized air.

As an alternative to driving gun system 12 by an air motor, an electric or hydraulic motor can obviously be used, source 326 then being an electric battery or generator or a hydraulic pump. As described for the illustrative air powered system, a hybrid driving system utilizing electric or hydraulic start up power and then switching to air drive by barrel gases may be provided.

A motor drive shaft 332 (FIG. 1) is drivingly connected to prime mover or motor 320 through a suitable transmission box (not shown), if required. Drive gear 334, which drivingly engages barrel assembly gear 220, is fixed to drive shaft 332 by a key 336 (FIG. 3). Shaft 332 is rotatably mounted through receiver rearward end plate 186, shell guide plates 50 and 48 and receiver forward end plate 180 by bearings 338, 340, 342 and 344, respectively, so as to enable the drive shaft to extend longitudinally through feeder 16. Driving means 18 operate feeder 16 through drive shaft 332 on which are mounted a spaced apart pair of feeder second conveyor drive sprockets 346, keyed to the drive shaft by keys 348 and a spaced apart pair of feeder third conveyor drive sprockets 350, keyed to the drive shaft by keys 352 (FIGS. 3, 4 and 5). Also mounted on drive shaft 332, intermediate the second and third drive sprockets 346 and 350, is feeder first conveyor, double drive sprocket 353, which is fixed to the drive shaft 332 by one or more keys 354.

Consistent with feeding shells 26 through, and ejecting fired shell casings from, gun 10 by rotatably driving barrel assembly 40 in the counterclockwise direction (direction of Arrow "A"), feeder second and third drive sprockets 350 and 354 are required, as more particularly described below, to be driven in a clockwise direction (direction of Arrow "B" FIGS. 4 and 5). For convenience of such operation, the feeder sprockets 350 and 354 are, as above mentioned, fixed to drive shaft 332 and prime mover 320 is configured for rotating the drive shaft in the clockwise direction (direction of Arrow "B", FIG. 1). Gear 334 fixed to drive shaft 332 and driving barrel assembly gear 220 causes counterclockwise rotation of barrel assembly 40 in response to clockwise rotation of the drive shaft.

A second drive gear 358 (FIG. 1) is non-rotatably mounted on drive shaft 332 rearwardly of gear 334. Second drive gear 358 drives intermeshed gear 360 which is non-rotatably mounted on stub shaft 362. A drive sprocket 364 is also non-rotatably mounted on shaft 362. Clockwise rotation of drive shaft thereby causes counterclockwise rotation of stub shaft 362 and hence of drive sprocket 364 fixed thereto. Shaft 362 is rotatably mounted in gun system 12 by conventional means (not shown).

Figure 13:
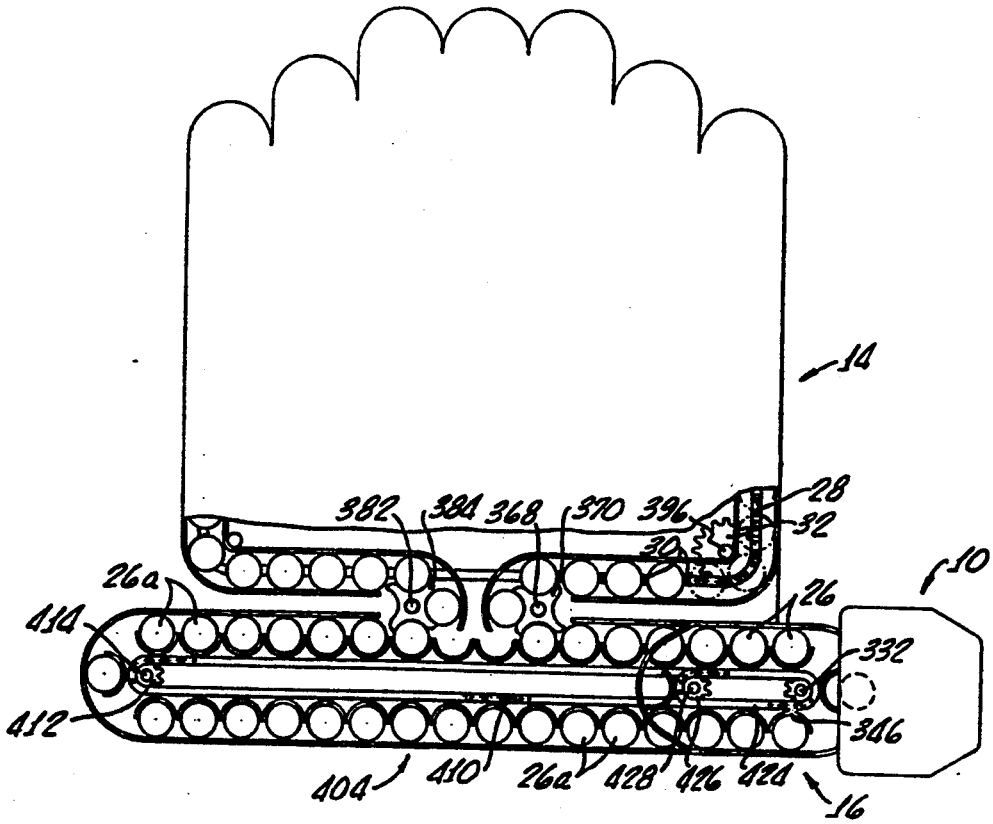
FIG. 13 is a transverse cross-sectional drawing taken along line 13—13 of FIG. 1 showing internal construction of the shell magazine and feeder associated with the automatic gun; and, FIG. 14 is a partially cutaway plan view of the gun system of FIG. 1, showing the feeder shell feeding path.
Figure 14:
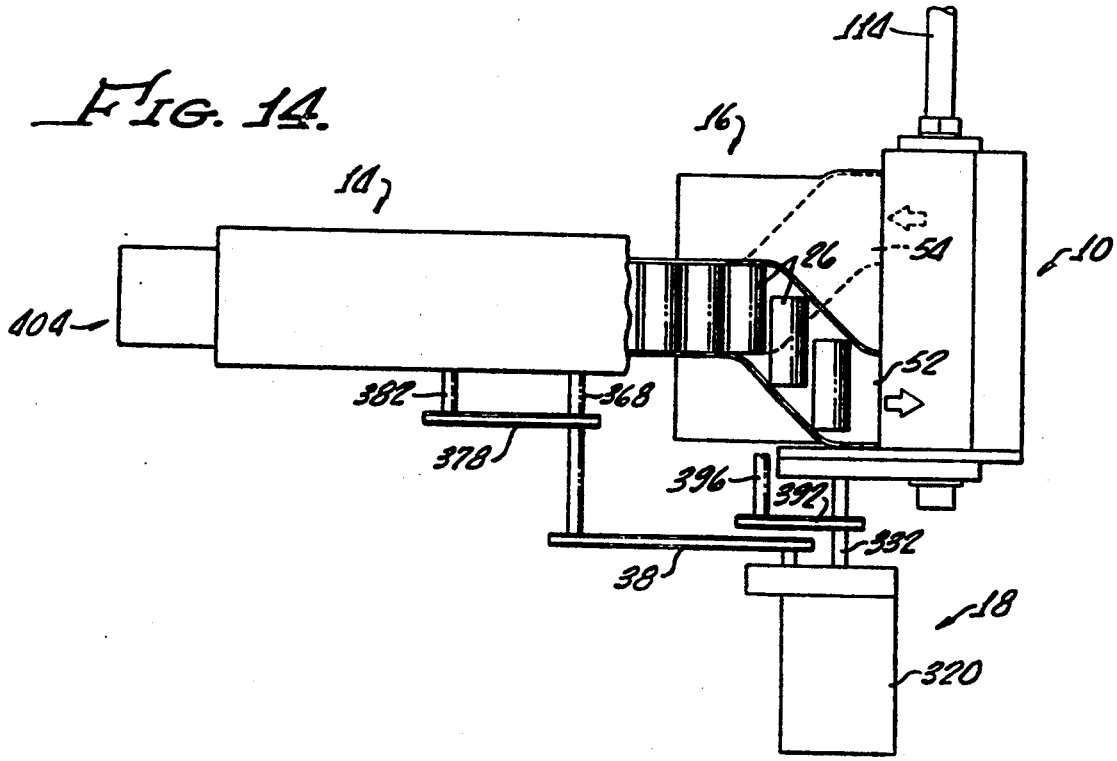

Drive chain 38 is entrained over drive sprocket 364 and also over another sprocket 366 which is non-rotatably mounted on a feeder drive shaft 368 (FIG. 1) to which is also fixed a shell feeding star wheel or rotor 370 (FIG. 13). A second drive sprocket 372 is non-rotatably mounted on feeder drive shaft 368 intermediate sprocket 366 and star wheel 370. As shown in FIG. 1, clockwise rotation of prime mover drive shaft 332 causes rotation of feeder drive shaft 368 in a counterclockwise direction (Arrow "A"), that is, in the same rotational direction as that of barrel assembly 40.

A drive chain 378 is entrained around feeder sprocket 372 and also around another feeder sprocket 380 which is, in turn, non-rotatably fixed to a second feeder drive shaft 382. Also non-rotatably mounted on shaft 382, forwardly of sprocket 380, is casing star wheel or rotor 384 (FIG. 13). Star wheels 370 and 384 are constrained to rotate in the same direction and at the same rotational velocity by drive chain 378.

An additional drive sprocket 390 is non-rotatably mounted on prime mover drive shaft 332 intermediate gears 334 and 358 (FIG. 1). A drive chain 392 is entrained around sprocket 390 and also around a magazine drive sprocket 394 which is non-rotatably mounted on a magazine drive shaft 396. Such shaft 396 is non-rotatably connected to a pair of the magazine drive sprockets 32 over which the magazine conveyor 28 is entrained. As a result of the manner by which magazine drive shaft 396 is driven by prime mover drive shaft 332, magazine conveyor sprockets 32 are rotated in the same direction (clockwise as shown in FIGS. 1 and 13) as drive shaft 332.

For illustrative purposes, driving means 18 has been shown and described as employing a number of drive shafts interconnected through gears or drive chains and sprockets so that prime mover 18 simultaneously operates gun 10 (through barrel assembly 40), feeder 16 and magazine 14 in a coordinated manner transporting shells 26 from magazine 14 into chamber apertures 68 and 70 for firing and ejecting shell casings **26*a* from gun 10 and transporting them back to magazine 14** for storage. It is to be appreciated, however, that other coordinated driving means may alternatively be provided.

Feeder or feeding means 16, as shown in FIGS. 3, 12–14, comprises first, second and third shell conveyors 404,406 and 408, respectively, which are arranged in side-by-side order with the second conveyor rearwardly adjacent the first conveyor and the third conveyor forwardly adjacent the first conveyor. Conveyors 404,406 and 408 are so arranged that, when operatively assembled to gun 10, second conveyor 406 is aligned in shell feeding relationship to rotor shell-holding recesses 140 and 142, through feed port 52, and third conveyor 408 is aligned in casing receiving relationship with rotor shell-holding recesses 136 and 138, through ejection port 54.

First conveyor 404 includes a pair of drive chains 410 which are entrained around sprockets 354 (mounted on drive shaft 332) and around out-board sprockets 412 fixed to a sprocket shaft 414 (FIGS. 3 and 13). Shaft 414 is maintained in spaced relationship with shaft 332 by conventional frame members (not shown). A relatively large number of arcuate shell-holding elements 416 are connected to drive chains 410 for transporting shells 26 and casings **26*a***.

Mounting of first conveyor 404 is such that an upper region of the conveyor is in shell receiving relationship with shell star wheel 370 and a rearwardly adjacent conveyor region is in casing delivery relationship with casing star wheel 384. Accordingly, in response to movement of first conveyor 404 and magazine conveyor 28 and to rotation of shell star wheel 384, shells are loaded from magazine conveyor 28, by star wheel 370, into first conveyor shell holding elements 416. Simultaneously, shell casings being transported by first conveyor 404 are picked off, by star wheel 384, and loaded thereby into empty regions of magazine conveyor 28.

Second and third feeder conveyors 406 and 408 are similar in construction to first conveyor 404. Second conveyor 406, which includes a pair of drive chains 424 which are entrained over the sprockets 346 fixed to drive shaft 332, such chains also being entrained over sprockets 426 non-rotatably mounted on a common first and third conveyor shaft 428. A number of shell holding elements 430, similar to first conveyor elements 416, are connected to drive chains 424. Third conveyor 408 includes a pair of drive chains 432 entrained over sprockets 346 fixed to drive shaft 322 and a pair of sprockets 434 non-rotatably mounted on conveyor shaft 428. A number of shell holding elements 436 are connected to third conveyor drive chains 432.

Upon assembly, conveyor shaft 428 is received into slots 438 and 440 formed, respectively, into projecting ends of shell guide plates 48 and 50 (FIG. 2), it being recalled that drive shaft 332 is rotatably mounted through such guide plates. Chain tensioning means 442 and 444 are installed, respectively, in apertures 446 and 448 formed in guide plates 48 and 50 just in-board of shaft slots 438 and 440. These chain tensioning means 442 and 444 enable tensioning of second and third conveyor chains 424 and 432 by adjustably positioning conveyor shaft 428 in slots 438 and 440.

Figure 12:
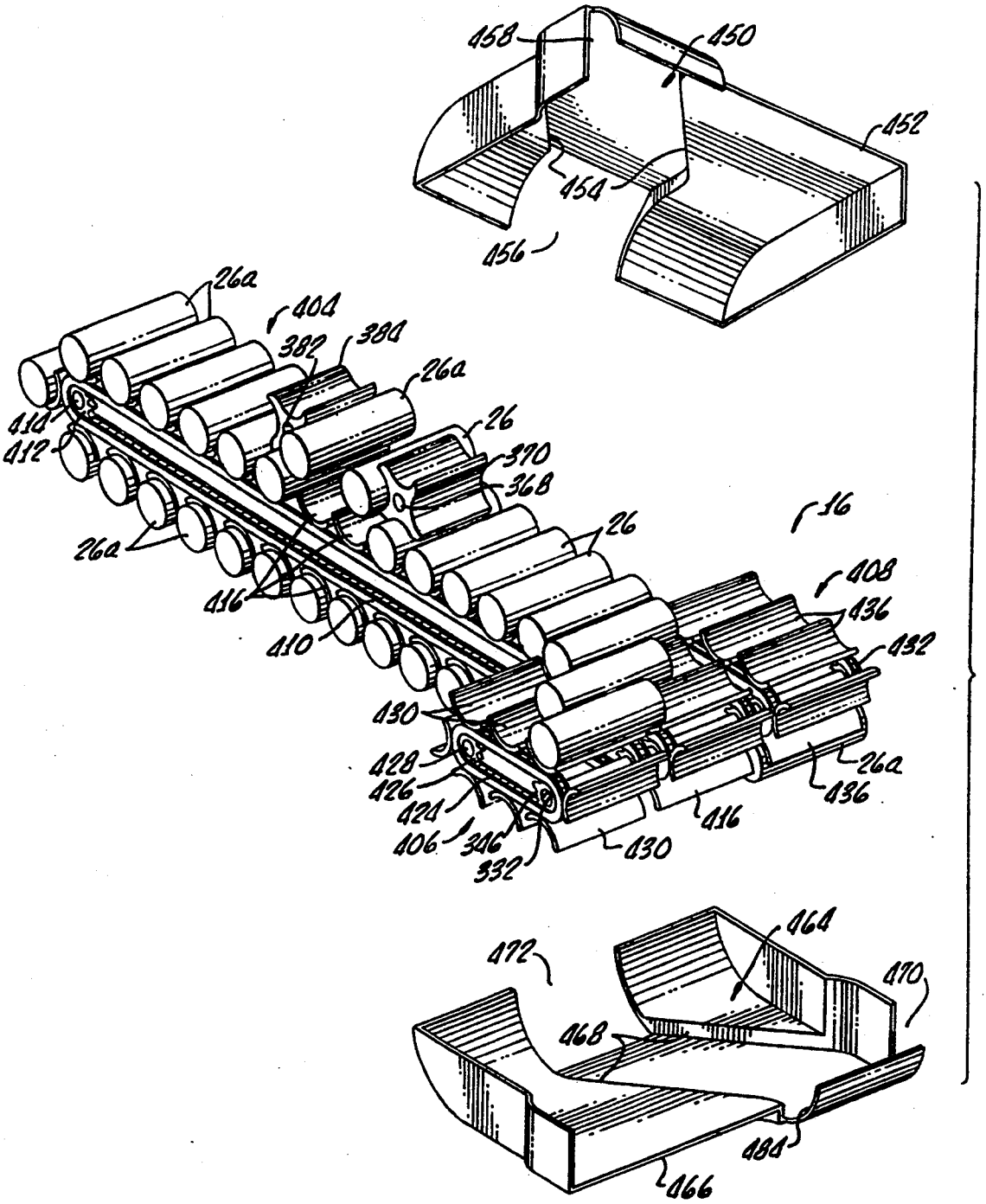
FIG. 12 is an exploded, perspective drawing of an associated shell feeding means for feeding shells from an associated magazine to the gun and for feeding fired shell casings from the gun back to the magazine for storage.

During feeding of gun 10 by feeder 16, shells 26 are sidewardly diverted from first conveyor 404 into second conveyor 406 by shell diverting means 450 mounted to the underside of feeder top cover 452 (FIG. 12). Shell diverting means 450 comprise a pair of spaced apart, "S"-shaped guides 454 which start at a first conveyor, shell entry aperture 456 and terminate at a second conveyor exit aperture 458 (aligned with gun feed port 52). Shell diverting means 450 cause shells 26 transferred from magazine conveyor 28, by star wheel 384, to first conveyor shell holding elements 416 to be rearwardly diverted, in response to movement of first and 'second conveyors 404 and 406, into rearwardly adjacent, second conveyor shell holding elements 430 so the shells can be delivered by the second conveyor to gun feed port 52.

Casing diverting means 464, fixed to the inside of feeder bottom cover 466, are similarly provided for diverting shell casings from third conveyor 408 into first conveyor 404 (FIG. 12). Casing diverting means 464 comprise a pair of spaced apart, "S"-shaped guides 468 which start at a third conveyor, casing entry aperture 470 (aligned with gun ejection port 54) and terminate at a casing ejection exit port 472 aligned with first conveyor 406. Responsive to movement of first and third conveyors 404 and 408, casing diverting means 464 divert shell casings **26*a* picked up by third conveyor shell holding elements 436 from gun ejection port 54 rearwardly into rearwardly adjacent shell holding elements 416 of the first conveyor so that the first conveyor can transport the casings to casing star wheel 384 for feeding back into magazine conveyor 28**.

It is apparent from the foregoing description that much of the relative complicatedness of feeder 16 results from a requirement that fired shell casings **26*a* be returned from gun 10 to magazine conveyor 28. Such a casing return requirement dictates the described use of the three conveyors 404, 406 and 408 for the handing-off of shells 26 from the first to the second conveyors and of casings from the third to the first conveyors. A much simpler feeder can, of course, be provided if the only required feeder function is the feeding of shells 26 from magazine 14 to gun 10 and casings 26***a* can be jettisoned from the gun.

OPERATION

Operation of gun 10 in conjunction with magazine 14 and feeder 16 is generally apparent from the above description. Prime mover 320 of driving means 18 is activated, for example, by the supplying thereto of pressurized air, gas, or hydraulic fluid or by electric power, so as to drive gun 10 (barrel assembly 40) conveyors 404, 406 and 408 of feeder 16 and conveyor 28 of magazine 14 in unison and in the directions described above, and in a continuous manner during firing.

Shells 26 are, as shown in FIG. 12, transferred by star wheel 370 from magazine conveyor 28 to feeder first conveyor 404 which transports the shells towards gun 10. Shell diverting means 450, however, divert shells from first conveyor 404 into shell holding elements 430 of feeder second conveyor 406 which transports the shells on to gun feed port 52.

To ensure reliable feeding of shells 26 from moving feeder second conveyor 406 into rotating gun rotor shell holding recesses 140 and 142, appropriate shell feed velocity is required in the transferring operation. The appropriate increase in shell velocity from second conveyor 406 to rotor 116 is attained by handing off shells from the conveyor to the rotor recesses as the shells speed up by going around conveyor sprockets 346. An additional amount of shell velocity increase is achieved by increasing the radius of shell path curvature as the shell follows an arcuate guide surface 476 of guide 50, and a corresponding guide surface 478 of a corresponding guide 480 fixed to the forward side of receiver end plate 186 (FIG. 2). Shells 26 are stripped from first conveyor shell-holding elements 430 by guide 168 fixed to shell guide member 262 between guide plates 50 and 480.

Once transferred in the described manner into rotor shell-holding recesses 140 and 142, rotation of barrel assembly 40 moves the shell 26 held in rotor recess 140 or 142 around the inside of receiver assembly 42 (FIGS. 7*a*, 7*b*, 7*c*). Camming means 196 permits shell 26 to move radially outwardly, the amount necessary to align the shell with the forwardly adjacent chamber shell holding cavity 68 or 70. At the 120 degree rotational point (FIGS. 7*d* and 8*d*) shell 26 is aligned with the adjacent chamber cavity 68 or 70 and the shell end region 266 engages camming surface 264. Continued rotation of barrel assembly 40 causes camming surface 264 to push shell 26 forwardly into chamber cavity 68 or 70, thereby causing a fired shell casing 26*a* held in the same chamber cavity 68 or 70 to be pushed forwardly out of the cavity (FIGS. 7*d*–7*f* and 8*d*–8*f*). At the 240 degree rotational point (FIGS. 7*g* and 8*g*) shell 26 has been completely inserted into the chamber cavity 68 or 70 and the shell casing 26*a* held in the cavity has been fully pushed out ("extracted") from the cavity. At the 180 degree point (intermediate the positions of FIGS. 7*e* and 7*f*) a next shell 26 is picked up from feeder 16 by the other one of the rotor recesses 68 or 70.

As barrel assembly 40 continues to rotate, the first shell 26 is moved towards firing position 104 and the next shell 26 is moved around the inside of receiver assembly 42 towards camming surface 264. (FIGS. 7*h* and 8*h*). At the 300 degree rotational position (180 degrees plus 120 degrees), the next shell 26 is aligned with the forwardly adjacent one of the chamber cavities 68 or 70 and shell base 266 engages camming surface 264 (FIGS. 7*i* and 8*i*).

At the 330 degree positions, (FIGS. 7*j* and 8*j*) the first shell 26 reaches firing position 104 and is automatically fired by firing pin 292. The next shell 26 is, at this point, partially inserted into its adjacent chamber cavity 68 or 70. First shell 26 remains in firing position 104 as barrel assembly 40 continues to rotate. At the next 30 degree rotational position (FIGS. 7*a* and 8*a*) chamber assembly 46 starts moving the first shell out of firing position 104; insertion of next shell 26 into its chamber cavity 68 or 70 continues. At the 60 degree rotational position (FIGS. 7*b* and 8*b*) the next shell 26 is fully inserted into its chamber cavity 68 or 70 and at the 150 degree position such shell fires (FIGS. 7*e* and 8*e*) the insertion process for a still next shell starting at the 120 degree point (FIGS. 7*d* and 8*d*).

FIG. 8 more particularly depicts the shell insertion and firing and casing ejection process through 360 degrees of barrel assembly 40. In FIG. 8*a* (30 degrees of rotation) shell No. 1 which has already been fired is being ejected from a first one of the chamber cavities 68 or 70 by an incoming shell No. 3. Shell No. 2, in the second chamber cavity 68 or 70 is just firing. At 60 degrees (FIG. 8*b*) shell No. 3 is fully inserted and shell No. 1 is fully pushed out of the first cavity; the casing of shell No. 2 is still loaded in the second cavity.

At 90 degrees (FIG. 8*c*) shell No. 3 and the casing of shell No. 2 are still loaded in their respective chamber cavities and shell No. 4 is approaching alignment with the second cavity. FIG. 8*d* indicates that at the 120 degree point, shell No. 4 is aligned or almost aligned with the second cavity in readyness for insertion thereinto. At 150 degrees (FIG. 8*e*), shell No. 3 in the first cavity fires and shell No. 4 has been pushed partially into the second cavity, thereby starting to push out the casing of shell No. 2. At 240 degrees, shell No. 4 has been fully loaded into the second chamber cavity; the casing of fired shell No. 3 is still in the first cavity.

FIG. 8*h* depicts the 270 degree position in which shell No. 5 is approaching alignment with the first chamber cavity; shell No. 4 is in the second cavity and the casing of fired shell No. 3 is still in the first cavity. At the 300 degree point, Shell No. 5 is aligned or almost aligned with the first cavity and upon alignment insertion of the shell into the cavity starts (FIG. 8*i*). At 330 degrees of rotation, shell No. 4 in the second cavity is fired and shell No. 5 is partially inserted into the first cavity, thereby pushing up casing of shell No. 3 out of the cavity.

The feeding, firing and extraction process continues in a like manner as long as rotation of barrel assembly 40 continues and as long as the supply of shells lasts.

Shell casings 26*a* pushed out of, or "extracted" from, chamber cavities 68 and 70 in the above-described manner are guided by camming surface 270 as they are received into rotor recesses 136 or 138, and are transported thereby around the inside of receiver assembly 42 to extraction port 54. At port 54 the casings 26*a* are picked up by feeder third conveyor 408, being guided along a surface 479 of guide plate 48, an arcuate surface 481 of a small guide 483 fixed to receiver forward end plate 180 and a surface 484 of guide 164 (FIGS. 2 and 5). Shell casing velocity is matched to velocity of third conveyor shell-holding members 436 to the casing pickup point occuring as the casings 26a increase velocity by changing from linear to arcuate movement around sprockets 350.

From third conveyor 408, casings 26a are sidewardly diverted to first conveyor 404 by guides 454 (FIG. 12). Casings 26a are removed from first conveyor 404 and are loaded back into magazine 14 by casing star wheel 384.

As above described, gun 10 is constructed in a symmetrical or complimentary manner so as to enable shells 26 to be fed into the gun through forward port 54 when barrel assembly 40 is rotated, by driving means 18, in a clockwise direction (direction of Arrow "B"). Shell casings 26 are then ejected from rearward receiver port 52. Accordingly, the feeding/ejection functions of ports 52 and 54 depend upon direction of barrel assembly rotation, port 52 alternatively function as a feeding port and an ejection port when barrel assembly rotational direction is reversed from counterclockwise to clockwise.

Guide plates 48 and 50 are shown in FIG. 2 and are described as forming part of receiver assembly 42. From the above description it is, however, apparent that guide plates 48 and 50 also comprise part of feeder 16 which is, in fact, integrated upon assembly into receiver assembly 42. Such feeder-receiver assembly integration is desirable to assure proper shell feeding to gun 10 and proper casing feeding from the gun.

Although there has been described above a specific arrangement of an automatic gun, in accordance with the invention for the purpose of illustrating the manner in which the invention may be used to advantage, it will be appreciated that the invention is not limited thereto. Accordingly, any and all modifications, variations or equivalent arrangements and methods which may occur to those skilled in the art should be considered to be within tile scope of the invention as defined in the appended claims.

What is claimed is:

1. A shell feeder for feeding an automatic gun, having spaced apart shell feeding and shell casing ejection ports, from a magazine having an unfired shell out-feed port and a fired shell casing in-feed port, the feeder comprising:

(a) first conveyor means for picking up unfired shells from the magazine shell out-feed port and delivering fired shell casings to the magazine casing in-feed port;

(b) second conveyor means for feeding shells from the first conveyor means to the gun shell feeding port, (c) third conveyor means for feeding fired shell casings from the gun casing ejection port to the first conveyor means, (d) guiding means, for causing in response to shell transferring movement of said first, second and third conveyors the transfer of unfired shells from the first conveyor means to the second conveyor means for causing the transfer of fired shell casings from the third conveyor means to the first conveyor means; and, (e) means for driving the first, second and third conveyor means in a preselected direction causing the second conveyor means to feed shells from the first conveyor means to the associated gun and the third conveyor to feed fired shell casings from the gun to the first conveying means.

2. The shell feeder according to claim 1 wherein the associated gun is externally driven and wherein said feeder drive means are interconnected with the means for externally driving the gun, so as to drive the feeder and gun in sychronization.

3. The shell feeder according to claim 1 wherein said first conveyor means pick up shells from, and deliver shell casings to, the magazine at a first transport velocity and wherein the gun accepts shells and ejects shell casings at a second, higher transport velocity and wherein said second conveyor means include means for increasing shell velocity from the first to the second velocities and the third conveyor means include means for decreasing shell casing velocity from the second to the first velocities.

4. The shell feeder according to claim 3 wherein the means for increasing shell velocity include means for changing the feeding movement of the second conveyor from linear to curvilinear movement and wherein the means for decreasing shell casing velocity include means for changing the feeding movement of the third conveyor from curvilinear to linear movement.

5. The shell feeder according to claim 1 wherein the first, second and third conveyor means comprise, respectively, first, second and third endless loop conveyors having means defining a number of spaced apart holders for cylindrical shells and shell casings.

6. The shell feeder according to claim 5 including means interconnecting the first, second and third conveyors in a side-by-side relationship with the second conveyor on one side of the first conveyor and the third conveyor on the other side of the first conveyor, and wherein the guiding means include a first guide for sidewardly diverting unfired shells from the first conveyor into the second conveyor and second guide for sidewardly diverting fired shell casings from the third conveyor shell holders into the first conveyor shell holders, both of said guides being responsive to feeding movement of the conveyors.

7. The shell feeder according to claim 5 wherein the first, second and third conveyors are configured and connected for bidirectional feeding movement and wherein the conveyor drive means are configured for selectively driving all three conveyors in one feeding direction for causing the first conveyor to feed unfired shells from the shell magazine to the second conveyor and the second conveyor to transport the shells to the associated gun for firing and for causing the third conveyor to transport fired shell casings from the associated gun to the first conveyor for transporting thereby back to the associated shell magazine, and for selectively driving all three conveyors in an opposite feeding direction for causing the first conveyor to feed unfired shells from the shell magazine to the third conveyor and the third conveyor to transport said shells to the gun for firing and for causing the second conveyor to transport fired shell casings from the gun to the first conveyor for transporting thereby back to the shell magazine.

* * * * *